US008293167B2

(12) United States Patent
Bernard et al.

(10) Patent No.: US 8,293,167 B2
(45) Date of Patent: Oct. 23, 2012

(54) SURFACE TREATMENT OF METALLIC ARTICLES IN AN ATMOSPHERIC FURNACE

(75) Inventors: William J. Bernard, Perrysburg, OH (US); Ralph P. Poor, Toledo, OH (US); Garry W. Barbee, Rossford, OH (US); John W. Gottschalk, Perrysburg, OH (US)

(73) Assignee: Surface Combustion, Inc., Maumee, OH (US)

( * ) Notice: Subject to any disclaimer, the term of this patent is extended or adjusted under 35 U.S.C. 154(b) by 563 days.

(21) Appl. No.: 12/085,209

(22) PCT Filed: Nov. 21, 2006

(86) PCT No.: PCT/US2006/045007

§ 371 (c)(1),
(2), (4) Date: Jun. 20, 2008

(87) PCT Pub. No.: WO2007/062008

PCT Pub. Date: May 31, 2007

(65) Prior Publication Data

US 2008/0302281 A1 Dec. 11, 2008

Related U.S. Application Data

(60) Provisional application No. 60/739,568, filed on Nov. 23, 2005.

(51) Int. Cl.
*C21D 1/06* (2006.01)
*C21D 1/74* (2006.01)

(52) U.S. Cl. ..... 266/252; 148/215

(58) Field of Classification Search ..... 266/252, 266/249; 148/215, 240
See application file for complete search history.

(56) References Cited

U.S. PATENT DOCUMENTS

| | | | | |
|---|---|---|---|---|
| 2,364,893 | A | | 12/1944 | Endress |
| 2,907,857 | A | | 10/1959 | Monday |
| 3,968,957 | A | * | 7/1976 | Asai et al. ..... 266/257 |
| 4,030,712 | A | | 6/1977 | Rogers |
| 4,279,406 | A | * | 7/1981 | Bourhis et al. ..... 266/81 |
| 4,386,972 | A | | 6/1983 | Knight |
| 4,417,722 | A | | 11/1983 | Ishii et al. |
| 4,951,601 | A | | 8/1990 | Maydan et al. |
| 4,957,431 | A | | 9/1990 | Eng et al. |
| 4,963,091 | A | | 10/1990 | Hoetzl et al. |
| 5,033,927 | A | | 7/1991 | Pelissier |
| 5,137,616 | A | | 8/1992 | Poor et al. |
| 5,211,820 | A | | 5/1993 | Poor et al. |
| 5,261,976 | A | | 11/1993 | Schultz |
| 5,324,415 | A | | 6/1994 | Blumenthal et al. |

(Continued)

FOREIGN PATENT DOCUMENTS

| | | |
|---|---|---|
| CA | 2091209 A1 | 9/1993 |
| JP | H05-5851 | 1/1993 |
| WO | WO 2007062008 A2 | 5/2007 |

OTHER PUBLICATIONS

European Search Report Communication, Application No. EP06838146.6, Date Apr. 3, 2010.

(Continued)

*Primary Examiner* — Scott Kastler
(74) *Attorney, Agent, or Firm* — MacMillan, Sobanski & Todd, LLC

(57) ABSTRACT

A system for treating metallic articles in an atmospheric furnace while injecting at least one fluid material within the furnace and/or in a catalyst bed connected to the furnace.

31 Claims, 11 Drawing Sheets

U.S. PATENT DOCUMENTS

| | | | | |
|---|---|---|---|---|
| 5,385,337 | A | | 1/1995 | Schultz |
| 5,404,894 | A | | 4/1995 | Shiraiwa |
| 5,423,891 | A | | 6/1995 | Taylor |
| 5,478,985 | A | | 12/1995 | Hoetzl et al. |
| 5,512,320 | A | | 4/1996 | Turner et al. |
| 5,556,556 | A | | 9/1996 | Blumenthal et al. |
| 5,669,434 | A | * | 9/1997 | Nakao et al. ..... 164/97 |
| 5,676,821 | A | | 10/1997 | Heyse et al. |
| 6,065,964 | A | | 5/2000 | Pelissier |
| 6,143,083 | A | | 11/2000 | Yonemitsu et al. |
| 6,159,306 | A | | 12/2000 | Barbour |
| 6,231,290 | B1 | | 5/2001 | Kikuchi et al. |
| 6,234,788 | B1 | | 5/2001 | Lee |
| 6,391,114 | B1 | | 5/2002 | Kirimura |
| 6,548,030 | B2 | | 4/2003 | Heyse et al. |
| 6,627,145 | B2 | | 9/2003 | Eymin et al. |
| 6,814,573 | B2 | | 11/2004 | Hiramoto |
| 6,902,635 | B2 | | 6/2005 | Korwin et al. |
| 7,204,952 | B1 | | 4/2007 | Poor et al. |
| 7,267,793 | B2 | | 9/2007 | Poor et al. |
| 2003/0020214 | A1 | | 1/2003 | Poor et al. |
| 2003/0168125 | A1 | | 9/2003 | Goldsteinas et al. |

OTHER PUBLICATIONS

Ralph Poor, New Technology Vacuum Carburizing System Provides Far Reaching Process Versatility, Industrial-Heating.com-Jan. 2007, pp. 1-5.

Surface Standard Vacuum Furnaces, Midland-Ross Corporation 1976.

Multi-Chamber Vacuum Furnaces, Surface Combustion Inc., 1997, pp. 1-4.

A.J. Derosset and C.V. Berger, "Thermal and Catalytic Decomposition of Hydrocarbons", Universal Oil Products Co. Des. Planes, IL, an I/EC Unit Process Review, Industrial and Engineering Chemistry, vol. 53, No. 8, Aug. 1961, pp. 680-682.

Michael Lohrman and Winfried Grafen, Ipsen International GmbH, Kleve, Germany, "New Wrinkles in Low-Pressure Carburizing", Heat Treating Progress, Feb./Mar. 2001, pp. 47-51.

Piotr Kula, Institute of Material Science & Engineering, Josef Olejnik, Seco/Warwick (Poland) Ltd. Janusz Kowalski, Seco/Warwick Corp. "New Vacuum Carburizing Technology," Heat Treating Progress, Feb./Mar. 2001, pp. 57-60.

K.L. Yang and R.T. Yang, "The Accelerating and Retarding Effect of Hydrogen on Carbon Deposition on Metal Surfaces", Carbon, vol. 24, pp. 687-693, 1986.

European Search Report Communication, Application No. EP06838146.6, Date Mar. 4, 2010.

Notification of Reasons for Rejection From the Japan Patent Office, Application No. JP2008-542402, Dated May 29, 2012.

Translation of Notification of Reasons for Rejection From the Japan Patent Office, Application No. JP2008-542402, Dated May 29, 2012.

* cited by examiner

SURFACE TREATMENT OF METALLIC ARTICLES IN AN ATMOSPHERIC FURNACE

This application claims the benefit of U.S. Provisional Application No. 60/739,568, filed Nov. 23, 2005, and International Application No. PCT/US2006/045007, filed Nov. 21, 2006. The disclosures of both applications are fully and expressly incorporated herein by reference.

This invention relates generally to the treatment of metal articles in an atmospheric furnace.

BACKGROUND OF THE INVENTION

The treatment of surfaces of metallic articles includes such processes as carburizing, hardening, nitriding, bluing, blackening, controlled oxidizing and/or controlled reducing.

In particular, carburizing may be defined as the introduction or application of additional carbon to the surface of a ferrous metal article to increase the carbon content of the surface, and to some limited depth, beneath the surface (the depth of substantive penetration of the carbon hereinafter called "case") of the article. When the article is subsequently subjected to an additional heat treatment, the surface portion carburizes resulting in a substantially harder surface than the underlying virgin or "green" metal. This is known in the art as "hardening."

There are a number of processes that have been used to carburize ferrous articles. Perhaps the earliest application is "box carburizing" where open charcoal pits were used. Bone meal was packed around the articles to provide a protective atmosphere when heated and to be the source of carbon. That process has evolved into "pack carburizing" where articles to be carburized are packed into a box with a carburizing compound, such as metal carbonates burned to a hardwood charcoal by the use of oil, tar and the like, packed thereabout. Carbon is formed on the surface of the steel by the decomposition of carbon monoxide (from the carburizing compound) into carbon and carbon dioxide. The carbon dioxide that is formed reacts immediately with the uncondensed carbon in the carburizing compound to produce fresh carbon monoxide. This process is repeated as long as there is enough carbon present to react with the excess of carbon dioxide and until the surface of the ferrous article is saturated. This "class" of carburizing requires a solid carburizing compound "packed" about the article.

Another process which is used is liquid carburizing in which the steel or iron is placed in a molten salt bath that contains chemicals such as barium cyanide and the like required to produce a chafe comparable with one resulting from pack carburizing. The piece is placed in the bath for a predetermined length of time at elevated temperature such that the carbon diffuses into the surface of the metal. This "class" of carburizing is distinguished from the prior art to which this invention relates by its requirement for a liquid or salt bath into which the article is submerged.

Another process is "gas" carburizing in which a gas containing carbon is used as a gaseous material to provide gas phase carbon atoms to iron to produce the face centered iron with carbon in the matrix as well as iron carbide ($Fe_3C$) precipitate. Gas carburizing can be further divided into atmosphere gas carburizing and vacuum carburizing with vacuum ion carburizing as a separate species of vacuum carburizing.

Atmosphere gas carburizing is a well-developed technology that has proven acceptable for most case hardening carburizing applications. In atmosphere gas carburizing, a lower hydrocarbon typically natural gas (methane), propane or butane, is metered into an endothermic gas furnace atmosphere maintained at positive pressure (i.e., at "atmospheric" pressure) in an industrial furnace. By controlling the dew point of the gas composition (endothermic gas and carburizing gas), most typically the $CO/CO_2$ gas ratio (water gas shift reaction), the gas carbon potential is controlled. Typically, the gas carbon potential is below the saturation of carbon in the iron solution and when sufficient carbon in the iron matrix and iron carbide ($Fe_3C$) precipitates are formed throughout the surface, the gas carbon potential of the furnace atmosphere gas is changed to lower value ("equilibrium carburizing") to allow the carbon to diffuse into the case. The diffusion can be controlled vis-à-vis gas composition and temperature. For example, it is quite easy with atmosphere gas carburizing to actually decarb (remove carbon from) the surface during diffusion to allow a harder article composition between article surface and "green" core (portion of virgin metal beneath surface not affected by carburizing) because the case depth is increasing during diffusion.

Further, in atmosphere gas carburizing the carbon potential does not have to be set at saturation limits of the steel. Specifically, the carbon potential can be set at lesser values to avoid a natural phenomenon occurring at saturation referred to herein as "carbide network." That is, at saturation, the surface of the article comprises iron carbides closely packed as adjacent molecules of face centered carbon steel that can be viewed as linked together in a "carbide network." When carbon diffusion occurs it is potentially possible that groups or clusters of the packed iron carbide molecules are not homogeneous throughout the case. Conventional metallurgical thinking in the trade is that over time and at high stress, the carbide network can function as a stress riser. Some metallurgists, however, do not share this opinion.

With atmosphere gas carburizing, the carbide network can be minimized by controlling the carbon potential to minimize the formation of the network in the first place. That is, if carburizing does not occur at saturation, the network is not likely to be formed. In the past, atmosphere gas carburizing produced metal oxides on the article surface because of the presence of oxygen in the atmosphere. For this reason, atmosphere gas carburizing is fundamentally different from vacuum gas carburizing which does not have oxygen.

In the past, several atmospheric furnaces used butane and air, in which it is believed that the $CO_2$ raises CO levels and also leaks out the furnace to prevent sooting. It is also believed that water additions may have the same effect and boost hydrogen without boosting CO. When unsaturated aliphatic hydrocarbons break down during carburizing, they often produce a byproduct known as soot which includes solid carbon particles. The soot collects in the furnace during the carburizing process and must be removed. This requires extra maintenance and expense to keep the operation clean and reduces productivity. In the past, the higher order hydrocarbons especially had a tendency to deposit soot.

Carburizing typically occurs immediately upon introduction of the carburizing material into the furnace chamber. However, for an atmospheric carburizing furnace to work, it must first be "seasoned." Seasoning is the process of putting carbon into the furnace brick and alloy. "Green" furnace brick and alloy will provide a non-equilibrium carburizing environment for the work pieces. Until the furnace is seasoned, the work pieces will be low in carbon content and case hardness. The controllability of the process is therefore a function of the sensitivity of atmosphere carbon sensors and the ability of the gas flow metering valves to meter the gas. In order to control carbon potential, one must measure $CO_2$ level, dew point level, or oxygen content. Measurements of the gas composition in the furnace chamber are usually taken. One gas is measured and the enriching gas flow is controlled to produce a below saturated iron carbide surface that was subsequently diffused into the case. Where an additional nitrogen bearing gas was used (ammonia for carbonitriding), the additional gas was set to a fixed quantity.

For mixtures of the higher order unsaturated or saturated aliphatic hydrocarbons (which unsaturated hydrocarbons are highly reactive, such as, for example LPG) the process that is used to pressurize and deliver the gas to the furnace can affect the composition of the gas metered into the furnace. Depending on the purity of the feedstock and the gas delivery system, variations in the hydrocarbon makeup can occur. While there may be some cracking of the hydrocarbons in the delivery system that will not materially alter the carburizing process (since the hydrocarbon must be reacted anyway to produce the carbon by keeping the reaction going forward), in practice, variations do exist in the gas composition delivered to the furnace, causing imprecise control and variation in the repeatability of the process.

Atmosphere gas carburizing technology often uses a "Class 302" atmosphere, which is typically prepared by mixing a readily available hydrocarbon such as methane (natural gas) or propane with a greatly reduced amount of air than would be used for normal combustion. By definition, "Class 301" and "Class 302" ("lean" and "rich", respectively) endothermic atmospheres are formed by partial reaction of a mixture of fuel gas and air in an externally heated catalyst filled chamber. A "Class 301" atmosphere is generally defined as a "lean" endothermic and has a typical final product of: 45% $N_2$, 19.6% CO, 0.4% $CO_2$, 34.6% $H_2$, and 0.3% methane. A "Class 302" atmosphere is generally defined as a "rich" atmosphere and has a typical final product of: 39.8% $N_2$, 20.7% CO, low trace amounts of $CO_2$, 38.7% $H_2$, and 0.8% $CH_4$. For Class 302 atmospheres, the current technology endothermic gas generators produce a mixture typically defined as 40% $H_2$, 40% $N_2$, 19.6% CO, 0.3% $CO_2$ and 0.1% methane, based on natural gas. These chemistries change slightly depending on natural gas content, relative humidity of the incoming air and overall conditions of the catalyst and the generator itself, as well as natural gas make-up.

A protective atmosphere can be used in a Class 302 endothermic gas atmosphere for hardening processes; typically, in the 1500 to 1650° F. range; for carburizing, typically in the 1500 to 1850° F. range; or for carbonitriding typically in the 1500 to 1640° F. range.

In a conventional Class 301 or 302 endothermic generators, a mixture pump draws fuel gas to air mixture that is maintained by way of a gas regulator and air/gas mixer. The pump forces the mixture to enter the bottom (typically) of the reaction tube. The reaction tube, heated externally by flame or electric heating element, maintains a reaction tube (retort) temperature typically of 1900° F. to 2000° F. The inside of the reaction tube is filled with a nickel based catalyst where the air/gas mixture converts to the 40% $N_2$, 40% $H_2$, 20% CO mixture. Upon completion of the reaction, the product gas is quickly cooled to freeze the reaction. Cooling of the gas occurs by either a water cooler or air cooled heat exchanger. The first 20% of the retort tube is filled with an Allundum sphere which provides heating of the air/gas mixture, but does not promote chemical reactions. At the conclusion of the heating of the gas, the nickel catalyst is reached and a two-stage reaction occurs. The first stage combusts the air in the mixture, generating $N_2+H_2O+CO_2$+heat+excess feed. The second stage, in combination with heat supplied to the retort tube from external means, drives the $CO_2$ level down and creates CO. Likewise, excess fuel causes the $H_2O$ to drive down to $H_2$.

At such time, the mixture reaches the end of the reaction retort, the gas is chilled and frozen to the constituents mentioned earlier. Based on variations that occur in feed gas, variations in final CO level can occur causing variation in product gas carbon potential content. The present invention provides a control system to regulate these variations.

It is to be noted that changes alone, even though regulated, can cause changes in the final metallurgical outcome. Thus, elimination of the fluctuations would improve metallurgical results in demanding applications.

It is also to be noted that, in certain articles of the world, natural gas or propane may not be available. In these areas, high purity liquid hydrocarbons may be available. In such areas of the world and even in the United States, the feed gas supplies have high sulfur content. Sulfur levels, over 10 ppm, can damage the nickel catalyst in as little as a few hours. Having a high purity liquid hydrocarbon can eliminate the sulfur problem.

Typically, natural gas will yield a hydrogen level twice that of carbon monoxide. In gas carburizing, the CO content is the main vehicle for carrying carbon to the work piece. The byproducts of carburizing are oxygen and hydrogen. Having an atmosphere that is higher in CO and lower in hydrogen will be of benefit to the speed of the carburizing reaction. It is typical for carburizing to raise the carbon potential to 0.80% or higher. To do so, an enrichment gas, typically propane or methane is added to the furnace. During this time, the demand for carbon by a green article will consume the enrichment gas. As carbon consumption occurs, $CO_2$ and water vapor levels rise and conversely carbon potential falls.

To lower the $CO_2$ and water vapor levels, an enriching gas may be added. There are three primary reactions: $CH_4+CO_2$ becomes 2 $CO+2H_2$, and likewise, $H_2O+CH_4$ becomes CO and $3H_2$. When equilibrium is achieved at a given carbon potential set point, likewise $CO_2$ and $H_2O$ levels will also be stabilized in equilibrium. The third reaction is temperature dependent and $CH_4$ goes to carbon into the work surface and $2H_2$ is generated. Note that there are other reactions that occur with oxygen, and that to drive the reaction forward, hydrogen is generated from all three reactions as a resultant. The control of enriching gas is typically done by a motorized valve operator or a time proportioned on/off solenoid valve.

One of the problems associated with methane specifically is that the excess amounts of hydrogen generated dilute the otherwise desired CO. Since methane has two $H_2$'s per molecule of carbon, an abundance of hydrogen is generated and a likewise fall in CO occurs, more so with this hydrocarbon than the other, higher order, hydrocarbons. In certain cases, CO has been known to fall to as low as 15%. This is known as "CO depletion." The net result is that the carbon potential is difficult to achieve and methane levels rise due to the fact that insufficient CO is available to react with the methane and raise the carbon potential. The above effect is most prevalent in high surface area loads. In certain instances, the described "CO depletion" effect is less severe with propane gas due to the reduced hydrogen to carbon ratio.

In an atmosphere carburizing or hardening furnace, a Class 302 atmosphere is piped to the furnace or an atmosphere is created by flowing nitrogen, typically, or air in conjunction with a liquid-dripped into the furnace, such as methanol or acetone. Since a Class 302 atmosphere is 40% hydrogen, 40% nitrogen, and 20% CO, the Class 302 atmosphere has a carbon potential typically between 0.20% carbon and 0.45% carbon. Depending on the type of hydrocarbon used, the percentages of these three main components changes somewhat. In the past, there have been applications where a liquid is used for "enrichment" of the process. The amount of enrichment liquid used was very low and often, control of such small amounts of liquid was difficult to meter. In the past, variable speed pumps or very small motorized needle valves were used.

The vast majority of furnace Class 301 and Class 302 atmospheres are created using endothermic gas processes, as discussed above. However, there is a competing process that was very popular in the late 1970's and early 1980's when natural gas curtailment took place. During this era the alternate atmosphere using gaseous nitrogen and liquid methanol was fed directly into the furnace. A typical gas usage was 160 cfh nitrogen and one gallon per hour methanol. The combined nitrogen and methanol yielded an equivalent atmosphere of 400 cfh of 40% N2, 40% $H_2$ and 20% CO. The nitrogen methanol atmosphere does not require a generator and also does not rely on natural gas. For areas of the world where natural gas is not available, nitrogen methanol atmospheres are typically used.

The nitrogen is stored nearby outside as liquid and evaporated from liquid into a gas before entering the furnace. The methanol is also stored outdoors in liquid form and pumped into the furnace. The liquid methanol is dripped into the furnace, traditionally from overhead at a rate to yield the 40% $H_2$ and 20% CO levels. Upon dripping into the furnace, the methanol flows through a "sparger" pipe. Inside the furnace, the sparger pipe has a solid end and has a series of small holes drilled around its circumference. The liquid methanol cannot exit the end of the sparger since it is blocked, but most exits the small holes as a vapor.

However, there are several problems with this technology. First, the sparger is intended to vaporize the methanol. Liquid methanol dripping directly onto a workload will stain the load and yield non-uniformity in the carburized case. The end of the sparger is closed, forcing the vaporized methanol to leave through the small holes. As the sparger ages, the end of the sparger often falls off, causing the above problems. Second, due to the high carbon content of the methanol, the sparger holes become plugged with carbon causing the ratio of methanol to nitrogen to become "lean." This results in an extremely poor carburizing case or complete loss of the carburized case. Third, the one gallon per hour flow rate is very low. If the rate varies slightly lower, carbon potential can easily fall 10 to 20 points and an oxygen probe or $CO_2$ carbon control system will go into error. The workload will be undercased, low in surface carbon, and low in hardness, which are considered very undesirable. Should the flow rate be too high, the reverse will happen and there is potential for carbide networks in the workload and the furnace can easily become sooted.

All of these situations are considered very undesirable. It is noted that one gallon per hour is approximately equal to 2.1 liquid ounces per minute or 1 ml/sec. The control valves used to meter this liquid rate are very difficult to control with the desired accuracy needed to prevent the problems discussed above.

Further, when the sparger becomes plugged, there is a loss of the carrier gas for the furnace, causing the furnace pressure to drop to unsafe levels. Since the spargers are prone to plugging, this condition makes the furnace potentially unsafe.

SUMMARY OF THE INVENTION

In one aspect, there is provided a method and apparatus for treatment (such as carburizing, hardening or carbonitriding and the like) of a metallic article in an atmospheric furnace. The method includes heating the article to a desired temperature in an atmospheric furnace chamber, and metering a hydrocarbon material into the furnace chamber. The hydrocarbon material disassociates to produce carbon absorbed into an outer surface of the article to produce carbon in solution and an M-C on the surface of the article (where M is a desired metal such as iron and the like).

In certain embodiments, the method also includes providing the hydrocarbon material in liquid form and metering the liquid hydrocarbon material into the furnace chamber whereby the hydrocarbon material is vaporized into a gas or into an atomized liquid from the heat of the furnace chamber.

In certain embodiments, the method also includes providing at least one injector in fluid communication with the furnace, and injection pulsing the hydrocarbon material into the furnace by the injector. The injection pulsing is either fixed or variably set for at least one of: pulse time, pulse width and/or pulse frequencies.

In certain embodiments, the method also includes vaporizing the liquid hydrocarbon material in an expansion chamber downstream of the injector and upstream of the furnace chamber. The expansion chamber can be in direct fluid communication with the furnace chamber.

In certain embodiments, the method also includes one or more of: externally heating the expansion chamber providing a plurality of injectors spaced about the furnace chamber; at least one of: firing each injector at a set time in relation to the other injectors; varying a firing order of the injectors; and, varying at least one of widths and frequencies of the pulsed injections during the time the hydrocarbon material is injected into the furnace; wherein the frequency of the pulses, the pulse widths and the firing order are varied.

The injection pulsing of the hydrocarbon material is continued until a set volume of the hydrocarbon material has been injected into the furnace chamber, and maintaining a desired temperature in the furnace chamber to allow the carbon to diffuse into the surface of the article and form M-C, such as for example, $Fe_3C$. Thus, the injector pulsing the hydrocarbon material is continued until a set carbon potential is achieved.

The method includes raising or lowering the carbon potential by the changing of pulse width or pulse frequency. In certain embodiments, the method includes one or more of: maintaining carbon monoxide (CO) levels in the furnace chamber at least about 17% or greater, and maintaining hydrogen levels at levels less than the CO levels; maintaining a carbon potential in the furnace chamber at about 0.10% carbon to saturation; including maintaining a ratio of CO to hydrogen in the furnace chamber at about 1 to 1. In certain embodiments, the carbon potential is maintained in the furnace chamber at about 0.78% carbon. In certain embodiments, the hydrocarbon material forms within the furnace chamber: carbon monoxide (CO) levels of at least 4%, and hydrogen levels of at least 4% or greater; or carbon monoxide (CO) levels of about 4% or greater, and hydrogen levels about equal to or less than about 4%.

In certain embodiments, the method also includes varying one or more of: incoming nitrogen levels to yield desired carbon monoxide (CO) and/or hydrogen levels; incoming air levels to yield desired carbon monoxide (CO) and/or hydrogen levels; and, incoming air and nitrogen levels to yield desired carbon monoxide (CO) and/or hydrogen levels.

In certain embodiments, the hydrocarbon material forms within the furnace chamber carbon monoxide (CO) levels at least about 17% or greater, and hydrogen levels greater than the CO levels.

The hydrocarbon material can comprises at least one enrichment material to, raise or lower carbon potential. In certain embodiments, the hydrocarbon material comprises at least one, or a blend, of:

an unsaturated hydrocarbon having greater than 4 carbons; a cyclic hydrocarbon comprising at least one 5 or 6 sided carbon ring; saturated hydrocarbons; and blends thereof;

an alcohol including methanol, ethanol, butanol, and blends thereof;

a ketone including acetone, methyl ketone, ethyl ketone, and blends thereof;

a liquefied propane, butane, pentane, hexane, heptane, octane and blends thereof;

an unsaturated chain hydrocarbon including ethylene, propylene, butene, pentene, hexene, heptene, octene and blends thereof;

a saturated cyclic hydrocarbon including cyclopropane including methylcyclopropane; cyclobutane; cyclopentane, including methylcyclopentane and ethylcyclopentane; cyclohexane including methylcyclohexane, ethylcyclohexane, dimethyl cyclohexane, trimethyl cyclohexane; cycloheptane, and blends thereof;

an unsaturated cyclic hydrocarbon including benzene, toluene, xylene and blends thereof; and, diesel, jet fuel, kerosene, gasoline, and blends thereof.

In certain embodiments, the method also includes measuring a concentration of $CO_2$, dew point or oxygen level present inside the furnace chamber, and stopping or reducing the injection of the hydrocarbon material when a set level is detected.

In certain embodiments, the method also includes sensing the concentration of the carbon monoxide or hydrogen in the furnace chamber, and varying the flow of the hydrocarbons with the sensed concentration of the carbon monoxide or hydrogen.

In certain embodiments, the method also includes adding a source of monatomic nitrogen into the furnace chamber. The source of monatomic nitrogen can comprise at least one, or a blend, of: ammonia; at least one ring hydrocarbon which contains monatomic nitrogen; a cyclic hydrocarbon having at least one NH, $NH_2$, or $NHCH_3$ groups attached to any of the carbons in the ring, including aniline, methylpiperidine, piperidine, speridine, pyridine, cyclohexylamine, aminocyclohexane, cyclohexanamine, caffeine, nicotine, and blends thereon.

In certain embodiments, the surface treatment is continued until the surface of the article has a Rockwell C hardness of at least about 58 RC that continues until at least a depth of about 0.010 inches.

In certain embodiments, the supply of the hydrocarbon material comprises multiple, miscible hydrocarbons in a single supply. The carrier system can include supplies of the liquid or gaseous materials that comprise multiple, nonmiscible hydrocarbons, where each nonmiscible hydrocarbon is stored as a separate supply.

In certain embodiments, the hydrocarbon material comprises one or more of: at least carbon monoxide (CO) levels of at least 4%, and hydrogen levels of at least 4% or greater; carbon monoxide (CO) levels are 4% or greater, and hydrogen levels are equal to or less than 4%.

In certain embodiments, the carrier system includes one or more of: a device adapted to vary incoming nitrogen levels to yield desired carbon monoxide (CO) and/or hydrogen levels; a device adapted to vary incoming air levels to yield desired carbon monoxide (CO) and/or hydrogen levels; and, a device adapted to vary incoming air and nitrogen levels to yield the desired carbon monoxide (CO) and/or hydrogen levels.

In certain embodiments, the carrier system carbon monoxide (CO) levels in the furnace chamber are at least about 17% or greater, and hydrogen levels are less than the CO levels. Further, in certain embodiments, the hydrocarbon material comprises at least one enrichment material to raise or lower carbon potential.

In certain embodiments, the enrichment system can include a plurality of supplies of separate hydrocarbon materials. Each supply is in fluid communication with a supply conduit capable of receiving and combining the separate supplies of hydrocarbon materials and delivering the combined supplies to the furnace chamber. The hydrocarbon material comprises at least one hydrocarbon material that reacts to produce a carbon potential above or below the carbon potential of a carrier material.

In certain embodiments, the enrichment system includes a source of monatomic nitrogen introduced into the furnace chamber. The source of monatomic nitrogen can comprise at least one, or a blend, of: ammonia; at least one ring hydrocarbon which contains monatomic nitrogen; a cyclic hydrocarbon having at least one NH, $NH_2$, or $NHCH_3$ groups attached to any of the carbons in the ring, including aniline, methylpiperidine, piperidine, pyridine, speridine, cyclohexylamine, aminocyclohexane, cyclohexanamine, caffeine, nicotine, and blends thereon. In the enrichment system, the hydrocarbon material raises or lowers nascent nitrogen levels whereby nitrogen is diffused into the article.

In still another aspect, there is provided an atmospheric furnace for surface treating metallic articles. The furnace includes a furnace chamber that has an injector connected to the furnace chamber. The injector has an inlet in fluid communication with a source of at least one hydrocarbon material, and an outlet in fluid communication with the furnace chamber. The injector is adapted to deliver a metered quantity of the hydrocarbon material into the furnace chamber.

In certain embodiments, the furnace includes a plurality of injectors operatively positioned downstream from the hydrocarbon supply and upstream from the furnace chamber.

The furnace can further include a plurality of supplies of separate hydrocarbon materials. Each supply is in fluid communication with a supply conduit capable of receiving and combining the separate supplies of hydrocarbon materials and delivering the combined supplies to the furnace chamber.

In certain embodiments, the furnace includes: at least one primary injector for providing a first quantity of the hydrocarbon material, and at least one trim injector for providing a second quantity of the hydrocarbon material. The trim injector can have a lesser pounds/hour capability than the primary injector(s).

In certain embodiments, the furnace also has one or more supply conduits positioned downstream from the injector(s) and upstream from the furnace chamber. A hydrogen regulator is adapted to regulate the hydrocarbon material flowing through the supply conduit. A control device is connected to each injector and is adapted to independently control and inject the metered quantities of the hydrocarbon material.

In certain embodiments, the injector is adapted for pulsing discrete quantities of the hydrocarbon material into the furnace chamber at one or more of: set time intervals; variable time intervals; set pulse widths and/or frequencies; and variable pulse widths and/or frequencies.

In certain embodiments, the injectors are spaced about the furnace, where each injector adapted for one or more of: i) pulsing the hydrocarbon material at a set time in relation to the other injectors; ii) varying the frequency of the pulses; and iii) varying the pulse widths, wherein a desired mixture is obtained in the furnace of two or more discrete liquids or gaseous hydrocarbons.

In certain embodiments, the furnace includes at least one expansion chamber downstream of the injector and upstream of the furnace chamber, the expansion chamber adapted to allow the liquid material to be vaporized or atomized into a gas in the expansion chamber.

The furnace can further include a hydrogen gas inlet in fluid communication with the furnace chamber. The hydrogen gas inlet is adapted for receiving a source of hydrogen gas. A controller is adapted for metering the hydrogen through the inlet while the injector is pulsing the hydrocarbon material into the furnace chamber.

In certain embodiments, the furnace includes an inlet for adding a source of monatomic nitrogen into the furnace chamber.

In certain embodiments, the furnace further includes at least one generator adapted for delivering a carrier material to the furnace chamber. Also, the furnace can include a carrier system and/or an enrichment system.

In accordance with other aspects of the invention, features or objects disclosed include, in a broad sense, carburizing control achieved by hydrocarbon control with externally supplied carrier gas and liquid pulse injecting of the carburizing material (for example, any hydrocarbon).

These and other objects, features and advantages of the invention will become apparent to those skilled in the art from a reading of the Detailed Description set forth below together with the drawings as described below.

BRIEF DESCRIPTION OF THE DRAWINGS

The invention may take physical form in certain articles and in an arrangement of articles, a preferred embodiment of which will be described in detail and illustrated in the accompanying drawings which form an article hereof and wherein.

DETAILED DESCRIPTION OF THE PREFERRED EMBODIMENT(S)

Figure 1:
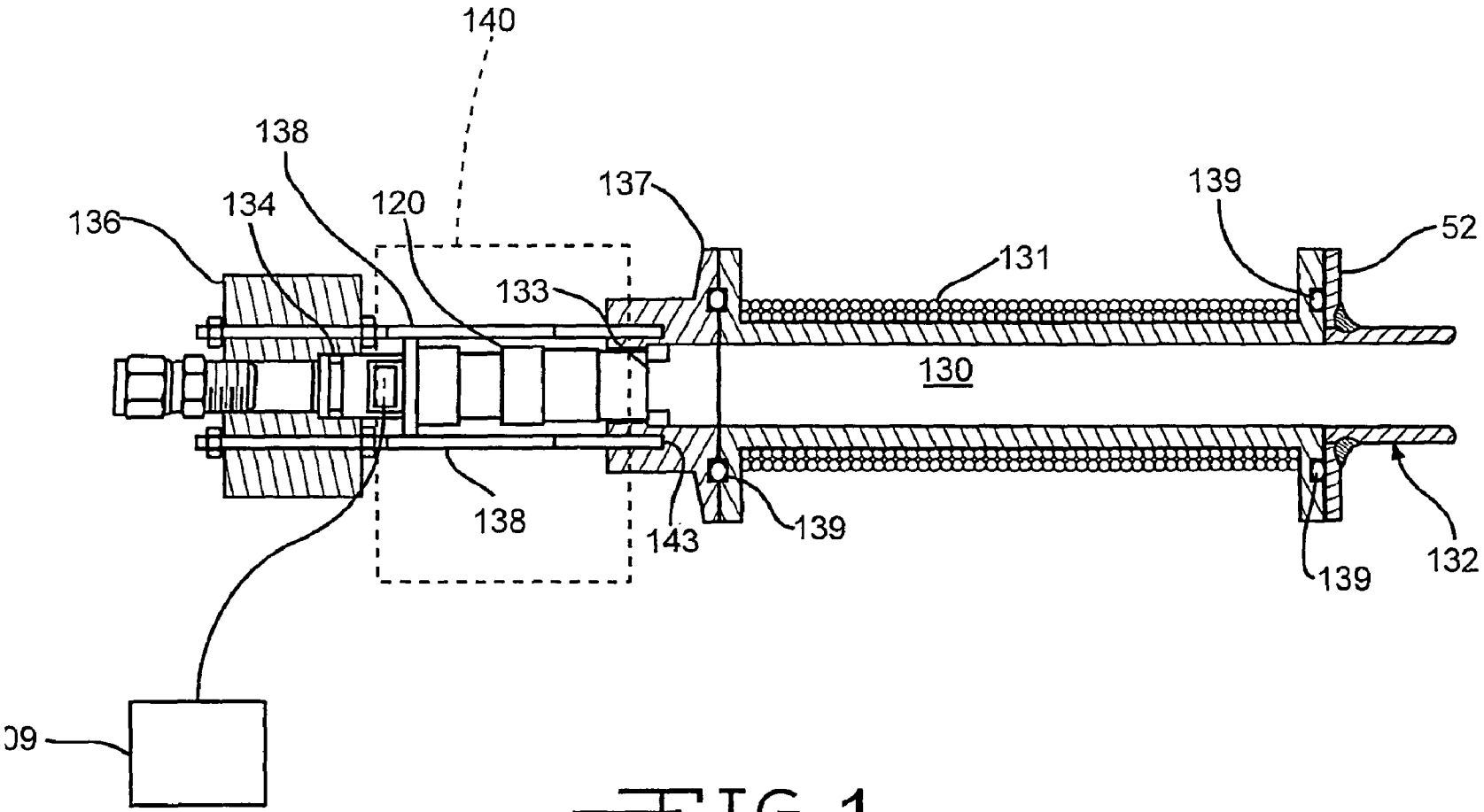
FIG. 1 is a cross-sectional view of an injector assembly.

In a broad aspect, there is provided an atmospheric-furnace for treating one or more metallic articles therein. The furnace includes a furnace chamber and one or more injectors. The injector has an inlet connected with a source of a fluid material, and an outlet connected with the furnace chamber. The injector adapted to deliver a metered quantity of the fluid material into the furnace chamber. It is to be understood that, in certain embodiments, the fluid material is in liquid form and in other embodiments, the fluid material can be in a gaseous form.

In another aspect, there is provided a generator for an atmospheric furnace for treating one or more metallic articles. The generator can include at least one catalyst bed connected to the furnace, and one or more injectors, as described above. The injector delivers a metered quantity of the fluid material into the catalyst bed.

In another aspect, there is provided an enrichment system for an atmospheric furnace for treating one or more metallic articles. The enrichment system includes one or more injectors as described above. The injector delivers a metered quantity of the fluid material into the furnace In yet another aspect, there is provided a carrier system for an atmospheric furnace for treating one or more metallic articles. The carrier system includes one or more injectors that delivers a metered quantity of the fluid material into the furnace.

In certain embodiments, the treatment of the metallic articles includes one or more of carburizing, hardening, nitriding (including carbonitriding and ferriticnitriding), bluing, blackening, controlled oxidizing and/or controlled reduction.

In a particular aspect, there is provided a method for atmospheric carburizing, hardening or carbonitriding where ferrous articles are heated to a carburizing temperature in a seasoned furnace chamber that is maintained at a desired temperature. A hydrocarbon material is injected within the furnace chamber and reacts to produce carbon absorbed into the surface of the article to produce carbon in solution and/or iron carbide, $Fe_3C$. The hydrocarbon or blends of hydrocarbons are metered into the furnace chamber. In certain embodiments, the hydrocarbon in the furnace chamber reacts with the carrier gas which, in turn, reacts with the ferrous article to maintain equilibrium of carbon potential between the work surface and the carrier gas.

In accordance with another aspect, the hydrocarbon is metered at a quantity sufficient to establish a carbon potential that produces saturated carbon in solution and iron carbide over the surface of the article or at a level below saturation, if desired. The process continues by maintaining a desired temperature after the hydrocarbon has been reduced into the furnace chamber for a set time period sufficient to allow diffusion of the carbon higher levels at the surface of the article into the case. It is also possible to perform equilibrium carburization where a below saturation set point is maintained at a constant level for the entire carburizing cycle.

In accordance with another aspect of the invention, the hydrocarbon is provided in liquid form and metered in liquid form into the furnace chamber whereupon the hydrocarbon is vaporized into gas or an atomized liquid from the heat of the furnace chamber. In certain embodiments, the hydrocarbon liquid feedstock is commercially available with purity levels in excess of 99%, preferably in excess of 99.9% pure, with the balance comprising various hydrocarbons so that variations in the carburizing gas do not occur resulting in precise control of the carburizing process to produce uniform carbon disbursed case with excellent repeatability. In many areas of the world, natural gas is used as the carburizing feedstock. This natural gas varies in composition and the variations can be in the form of $CO_2$, air, nitrogen and/or higher order hydrocarbons such as propane, butane and the like. The various components change from time to time and cause undetected upsets in the carbon potential. Likewise, the variations can cause errors in the carbon potential sensing instrumentation.

In certain embodiments, one or more injectors are spaced about the furnace chamber. The pulse width and frequency is varied during the time the gas is admitted into the furnace chamber. In certain embodiments the firing order or sequence may be varied to positively produce an improvement in dispersion of gas flow among and between the articles.

While injection pulsing of a liquid carburizing material has specific benefits with respect to its application for a liquid hydrocarbon because of the chemistry involved, the dispersion characteristics of the hydrocarbon achievable with pulse injection of a liquid hydrocarbon does not limit this aspect of the invention to a hydrocarbon carburizing material. Specifically, various hydrocarbons may be supplied in liquid form with pulsed injection to achieve a desired dispersion of the carburizing gas throughout the work and also to supply hydrocarbon in liquid feedstock form which may have higher purity than that which might otherwise occur with a conventional gas supply stream.

In accordance with one embodiment of the invention, the injector is provided with an expansion chamber downstream of its outlet and upstream of the furnace chamber whereby heat within the furnace chamber can be utilized to cause vaporization of the liquid hydrocarbon without adversely causing fluctuating temperature levels within the furnace chamber proper. While the furnace chamber is under a high temperature, it has been surprisingly discovered that the large volume of the furnace chamber serves to function as a reservoir and dampens the pulsation so that the temperature within the furnace is not adversely affected.

In accordance with another aspect of the invention, an atmospheric furnace for carburizing ferrous articles is provided. The atmospheric furnace includes a furnace casing defining a furnace chamber. A heater is provided within the furnace chamber. An injector is connected to the furnace. The injector has an inlet in fluid communication with the source of liquid hydrocarbon and an outlet in fluid communication with a furnace chamber. A microprocessor controller is provided for controlling the heater for regulating the temperature of the article in the furnace chamber, and for controlling the injector for regulating the pulsing of the injector, whereby the carburizing gas uniformly flows about the work surfaces of each article and between the spaces of the article.

In accordance with another aspect of the invention, the furnace casing is provided with one or more carrier gas inlets in fluid communication with the furnace chamber and a source of carrier gas with the controller regulating the metering of the carrier gas through the inlets while the injectors are pulsing the liquid hydrocarbon into the furnace. Preferably, when the carrier gas alternative embodiment is utilized, carrier gas is supplied to the furnace through the expansion chamber fitted to the injector further minimizing fluctuations attributed to the hydrocarbon pulse.

In accordance with yet another specific aspect of the invention, the furnace is provided with a sample line to the furnace chamber proper and an infrared $CO_2/CO/CH_4$ analyzer in the form of an NDIR sensor is in fluid communication. The controller regulates the hydrocarbon gas flow in accordance with the readings from the NDIR sensor, and the controller can optionally or additionally regulate the carrier gas flow either from the carbon monoxide readings or by separate instrument.

In yet another aspect, the present invention includes a treatment system (method and apparatus) that uses at least one hydrocarbon material and/or blends thereof as the carburizing material. The hydrocarbon materials provide one or more of the following desired characteristics:

a) better carburizing case for articles that have convoluted surfaces and/or tightly packed into the furnace (where the treatment system provides higher carbon monoxide levels and lower hydrogen levels);

b) minimum soot with bright carburized work (where the treatment system provides a high purity of the hydrocarbon source);

c) minimum sooting with especially bright carburized work and a clean furnace chamber (where the treatment system provides a stable hydrogen level and higher carbon monoxide levels);

d) variable carburizing is possible (attributed to $CO/CO_2$ ratio control, requiring less enriching hydrocarbon);

e) repeatability and consistency of carburizing that can be tightly controlled (where the treatment system provides a purity of the hydrocarbon in liquid form);

f) inexpensive processing (where the treatment system provides a cost analysis indicating that the high concentration of carbons in hydrocarbons results in less hydrocarbon material required); and h) easy controllability by use of $CO/CO_2$ instruments, dew point ($H_2O$ level) instruments, and/or oxygen probe control, with or without CO compensation.

A. THE "TREATMENT" OR "CARBURIZING" HYDROCARBON MATERIAL

While it is to be understood that the present invention relates in general to the surface treatment of metallic articles, the following explanation will be directed to the carburizing treatment for ease of explanation.

It is to be understood that the term "carburizing" generally includes the carburizing, hardening and carbonitriding, and the use of "carburizing" includes the use of hydrocarbon materials as described and claimed herein. The term "treating" can refer to such other surface treatments as bluing, blackening, controlled oxidation and controlled reduction and the like. It is also understood that those skilled in the art will readily understand the similarities and differences in such surface treatments and that the present inventive processes and apparatuses described herein are useful in all such surface treatments. As used herein, and as a matter of definition, the term "cyclic hydrocarbon" means those hydrocarbons having a carbon ring alignment connected by any number of bonds.

In one embodiment, the invention selects from the cyclic hydrocarbons those cyclic hydrocarbons which have a saturated ring and which are commonly referred to in the petrochemical industry as naphthenes.

Naphthenes are referred to as an anti-aromatic, although it may be possible to identify certain naphthenes as saturated aromatics. Naphthene, as used herein, includes those hydrocarbons (cycloalkanes) with the general formula $C_nH_{2n}$ in which the carbon atoms are arranged to form a ring.

In certain embodiments, among naphthene hydrocarbons, the six-sided ring has the greatest stability and is more stable than seven-sided rings and five is more stable than eight and nine is more stable than four and four has a greater stability than three. Not only are the 5 and 6 sided rings most stable, but it is believed that when sufficient energy is inputted to the ring, cracking of the carbon ring tends to proceed to produce activated carbon and hydrogen molecules. The reaction is not believed to tend to produce carbon sided rings of a lower order (assuming the reaction is not hydrogen starved) and the reaction is endothermic. Included in this specific group of naphthenes are cyclohexane, including variations thereof such as methylcyclohexane, ethyl cyclohexane, dimethyl cyclohexane, trimethyl cyclohexane, and cyclopentane including variations thereof such as methylcyclopentane, ethyl cyclopentane, and the like.

Also, in certain embodiments, the hydrocarbon material comprises at least one, or a blend, of:

an unsaturated hydrocarbon having greater than 4 carbons; a cyclic hydrocarbon comprising at least one 5 or 6 sided carbon ring; saturated hydrocarbons; and blends thereof;

an alcohol including methanol, ethanol, butanol, and blends thereof, a ketone including acetone, methyl ketone, ethyl ketone, and blends thereof;

a liquefied propane, butane, pentane, hexane, heptane, octane and blends thereof;

an unsaturated chain hydrocarbon including ethylene, propylene, butene, pentene, hexene, heptene, octene and blends thereof;

a saturated cyclic hydrocarbon including cyclopropane including methylcyclopropane; cyclobutane; cyclopentane, including methylcyclopentane and ethylcyclopentane; cyclohexane including methylcyclohexane, ethylcyclohexane, dimethyl cyclohexane, trimethyl cyclohexane; cycloheptane, and blends thereof;

an unsaturated cyclic hydrocarbon including benzene, toluene, xylene and blends thereof; and, diesel, jet fuel, kerosene, gasoline, and blends thereof.

In certain embodiments, the hydrocarbons are mixed with air in a partial oxidation reaction. The byproducts of this partial oxidation reaction are CO, hydrogen and nitrogen, with trace amounts of $CO_2$, $O_2$ and $H_2O$.

In another aspect, the present invention includes the use of hydrocarbons in a carrier gas alone, in an enrichment gas alone, or in both a carrier gas and in an enrichment gas, as will be further explained below.

B. REACTION DISCUSSION

Activity of the Carburizing Material

As used herein, "cracking" means the breaking or rupture of the carbon ring for cyclic hydrocarbons; and for aliphatics, means the splitting or disassociation of the hydrocarbon chain molecules into simpler hydrocarbon forms.

Aliphatic hydrocarbons crack according to the radical chain theory proceeding from complex hydrocarbons to intermediates and then to simpler forms with the progress of the reaction depending on the cracking condition. It is believed that any tendency of the hydrocarbon to form lower intermediate hydrocarbons such as ethylene, acetylene, propylene, etc., when the hydrocarbon is reacted, will be minimized due to the lengthy residence time within the furnace.

C. THE CARBURIZING MATERIAL DELIVERY SYSTEM

In certain embodiments, the carburizing material is supplied in fluid form. For example, cyclic hydrocarbons, and particularly the embodiments of naphthenes having 5 or 6 sided carbon rings are supplied in liquid form. Commercial cyclohexane comes in a very pure form of about 99.9% with the other 0.1% contamination being other hydrocarbons. The purity of the cyclohexane helps insure that reproducible control results can be obtained. Also, while 5 or 6 carbon ring naphthenes may be deemed to be a hazardous material according to Federal regulations as are many carburizing gases (and safety provisions must be complied with), it is well known that the naphthenes have a thermal stability and lack of reactivity. The cyclohexane: reacts with trace $CO_2$ to form CO and $H_2$, reacts with $H_2O$ to form $H_2$ and CO, and lastly, reacts with $O_2$ to form CO and $H_2$. The reactants fully react with the carrier gas. The unreacted balance is eventually burned by the furnace effluent pilots. In contrast, a conventional "sparger" approach creates an undesirable carbon drop out (soot), eventual plugging of the sparger, and failure of the carrier integrity.

According to one of the present inventions' broad aspects, this invention contemplates using different metering methods, such as direction injection via a simple control valve into the vessel; vaporizing the liquid with an external heater; or, small time pulse injection charges. For consistency in terminology, "metering" means introducing the hydrocarbon material into the furnace in any form and "injection" means introducing the hydrocarbon material in liquid form to the furnace. "Metering" therefore includes "injecting." "Injecting" however, as used herein, precludes or does not cover the use of any valving arrangement that regulates the flow of gas to the furnace. In certain embodiments, injecting can be accomplished by an injector or a liquid pump with appropriate valving.

The various methods for introducing the hydrocarbon material into the furnace include, for example:

a) Direct Injection using Control Valve—Direct injection via a control valve is by far the simplest in regard to hardware. A small needle valve allows a pressurized liquid supply to be admitted into the furnace.

b) Vaporizing with External Heater—Vaporizing the liquid with an external heater operating about 160° F. to 220° F. (depending on the hydrocarbon material selected), generates a gas and therefore is easier to mix with the carrier gas in the furnace. Mixing of the two gases is done outside the furnace completely and the mixed gases are passed into the vessel through one connection or can be mixed inside the furnace. The heater does require additional hardware and heat wrapping of the pipe leading to the furnace is typically required.

c) Injection via Metering of Carburizing Materials—Injecting, by using one or more injector assemblies that are capable of accurately delivering hydrocarbons. A supply pressure ranging from 15 to 50 psi from a small positive displacement pump and regulator is used. The injector time pulses "on" for a period of time on the order of milliseconds and injects small amounts, or "shots" of hydrocarbon material directly into a heated pipe. The amounts of the hydrocarbon material are small enough and are under sufficient pressure to allow for the complete injection of the hydrocarbon material into the furnace without the risk of pressure bubbles and blockages etc., that might occur with the direct injection method discussed above.

Increasing the duty cycle of the gas flow pulse to the injector increases the flow of liquid. Pulses of gas can occur. The duration or pulse can increase from a few milliseconds for low surface area loads to 500 milliseconds or more for high surface area loads. The frequency of the pulse can range from every second to longer periods, for example, every 15 seconds or shorter periods, for example, ⅓ of a second. In certain embodiments, injecting more often will also allow more volume of hydrocarbon material to be added to the system.

Because many hydrocarbons used in heat treat processing are supplied in bottled liquid form, there can be a semantical question as to the meaning of a liquid delivery system since the inventive liquid delivery system delivered the hydrocarbon material as a vapor in the furnace chamber. Therefore, as used herein, the liquid delivery system generally means that the hydrocarbon material in a liquid hydrocarbon form is metered as a liquid to the furnace chamber and remains as a liquid throughout the delivery system up to a point or a position which can be defined as being adjacent to the furnace casing. According to this definition, the vaporization of the liquid hydrocarbon to a gaseous hydrocarbon can occur either on the inside of the furnace casing or at a point adjacent the outside of the furnace casing. The flow of the carburizing material to the furnace is controlled with the carburizing material in a liquid form. This distinguishes from the prior art which uses bottled gas supplied in liquid form because the liquid when leaving the bottle is a gas which is remote from the furnace and the gas is regulated, typically by a simple mechanical flow meter. This also distinguishes from some plasma applications which literally pulse the gas to be ionized into the furnace chamber by solenoid actuated valves. The solenoid valves control a gas and not a liquid.

Referring now to the Figures, and as best shown in FIG. 1, an injector 120 is generally shown. The injector 120 is supported between front and rear O-rings 133, 134 which are mounted in bored and polished holes formed in a rear adapter plate 136 and a front adapter flange 137, respectively. Threaded rods 138 secure the rear adapter plate 136 to the front adapter flange 137. The front adapter flange 137 mounts to an expansion chamber 130 which mounts to a furnace casing 52. Several clamshell clamps, (not shown) compress the various O-rings 139 to provide a tight seal between the front adapter flange 137, the expansion chamber 130, and the furnace casing 52 (or conduits, as shown in FIGS. 6-10).

The vaporization of the liquid hydrocarbon to a gaseous state by the injector 120 causes a drop in temperature. Some cyclic hydrocarbons such as cyclohexane have freeze temperatures of about 40° F. while many naphthenes have lower freeze points with methylcyclohexane having a freeze point of −195° F. For example, a blend of naphthenes will produce a freeze point in the blend which is a composite of the individual naphthene freeze points, and naphthene blends are suitable for use in the invention.

In certain embodiments, the expansion chamber 130 has a desired size to allow about a 5 to 1 expansion from liquid to gas. In certain embodiments, the expansion chamber 130 can be as short as about 4 inches and as long as desired. In one embodiment, the expansion chamber 130 has a diameter of about 0.9" and a length of about 12". The expansion chamber 130 can be heated with a heater 131 (or covered with an insulating material such as brick, fiber insulation or heat tape), not only to prevent freezing for some of the hydrocarbons but also to insure that the vapor of the hydrocarbon stays as a vapor. The heater 131 is not always required since the furnace radiation can typically provide enough energy to keep liquid as a vapor. In certain embodiments, an inlet pipe 132 has an open end and is relatively large in diameter. Since the end of the inlet pipe 132 is open, there is no concern about the deterioration, or falling away, of the pipe end. Likewise, since the inlet pipe 132 does not require the small sparger holes, there are none of the concerns about causing damage or an unsafe furnace that a plugged sparger would cause.

In the embodiment shown in FIG. 1, the expansion chamber 130 is outside a furnace chamber. In other embodiments, this is not necessary and an arrangement can be used where the expansion chamber 130 can be positioned within the furnace, for example in the furnace wall. The size of expansion chamber 130 is calculated to be sufficient to allow the largest injected pulse to vaporize. In certain embodiments, the injector 120 does not require a separate expansion chamber. As noted above, the large volume of the furnace chamber can be viewed as a reservoir for damping pulsations which are not significant since they are timed in milliseconds. Still, for stability of the process, it is preferred that the liquid vaporizes into gas before leaving the expansion chamber 130.

In one embodiment, the injector 120 comprised an automobile fuel injector. Liquid flows were initially based on 35 millisecond pulses gated every second and 70 millisecond pulses gated every second. The gas usage repeats extremely close cycle after cycle with the 70 millisecond pulse consuming exactly double that of the 35 millisecond pulse. Timed electrical outputs were calibrated on an oscilloscope. Production versions have high speed clocks using a microprocessor. In one embodiment, the 35 milliseconds per second pulse consumed about 5.6 cc of cyclohexane each minute or 336 cc per hour. The liquid usage equates to a gas vapor flow rate of 1.23 liters per minute. Likewise, the 70 ms pulse consumed about 11 cc of cyclohexane per minute or 672 cc per hour for a gas vapor flow rate of 2.46 liters per minute. Total consumption was about 1,480 cc for 2¼ hour carburizing runs. Delivery pressure is typically set at 11 psig. The injector was designed for upwards of 50 psi, and normally runs in the 35-42 psig range for automotive applications. Also, the injector can run up to 800 ms each second before reaching about 80% maximum duty cycle so that the 70 ms cycle is only about a 9% duty cycle.

The pulse width can be varied, and in certain embodiments, a pulse width of from about 5 milliseconds to 700 milliseconds at injection pressures of about 15 to 50 psig is acceptable. If necessary, larger and smaller injectors can be used should there be substantial increases or decreases in flow requirements. For example, the injector used in the examples below was originally designed for automotive application and did not develop any leaks, nor did the O-rings experience softening or swelling when submerged in 100% cyclohexane for twelve months.

Also, the furnace chamber can be provided with multiple injectors. With regard to the positioning of the injectors, in certain embodiments, one or more injectors are mounted tangentially, with smaller furnaces being equipped with fewer injectors. The process can also operate using only one injector.

In certain embodiments, a controller 109 can readily implement the variations described above once the operator sets a set point desired in the controller 109. The controller 109 creates the required pulse widths for the injector to keep the system in equilibrium. It is to be understood that while all of the metering valves and gauges shown in the furnace drawings visually depict manual type devices, the gauges are sending signals to a master controller such as a Casemate® controller or to a specific controller such as a PID loop controller and the controller in turn, is outputting a command signal to actuators which control the valves or set the injection pulses. The master controller can send the command signal directly to the actuator controlling a valve or the command signal can be sent to a dedicated controller which in turn, will generate the actuator output signal.

D. GENERATOR AND FURNACE MULTI-INJECTOR ARRANGEMENT

It is to be noted that the discussion of furnace application centers about the articles being placed loose in trays moved into and out of the furnace chamber which is the procedure typically followed by commercial heat treaters. It is to be understood that any suitable method, such as conveyor systems using trays, mesh belts and the like can also be used. In other applications, such as for captive applications which involve-carburizing one particular article, the article may be fixtured and set in a fixed position in the furnace chamber.

It is also noted that in certain embodiments, the inlet pipe 132 for injector 120, when made out of high nickel chrome alloy, has remained repeatedly clean and bright during operation. Some cracking of the hydrocarbon in the inlet pipe 132 is possible because of the iron content in the stainless steel. However, it is believed that the speed of the vaporized pulse minimizes cracking of the carburizing material.

Figure 4:
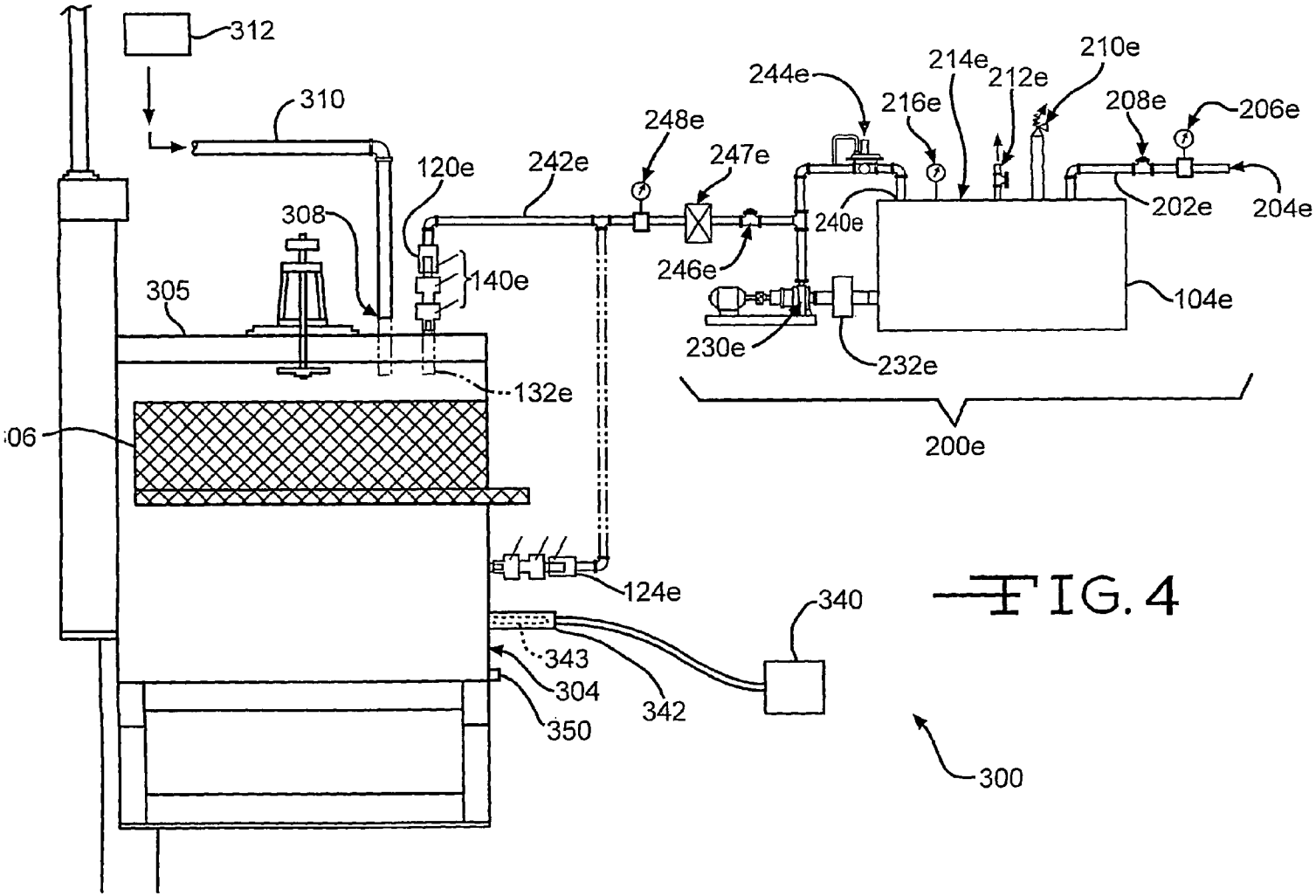
FIG. 4 is a schematic illustration of a liquid hydrocarbon enrichment system.
Figure 5:
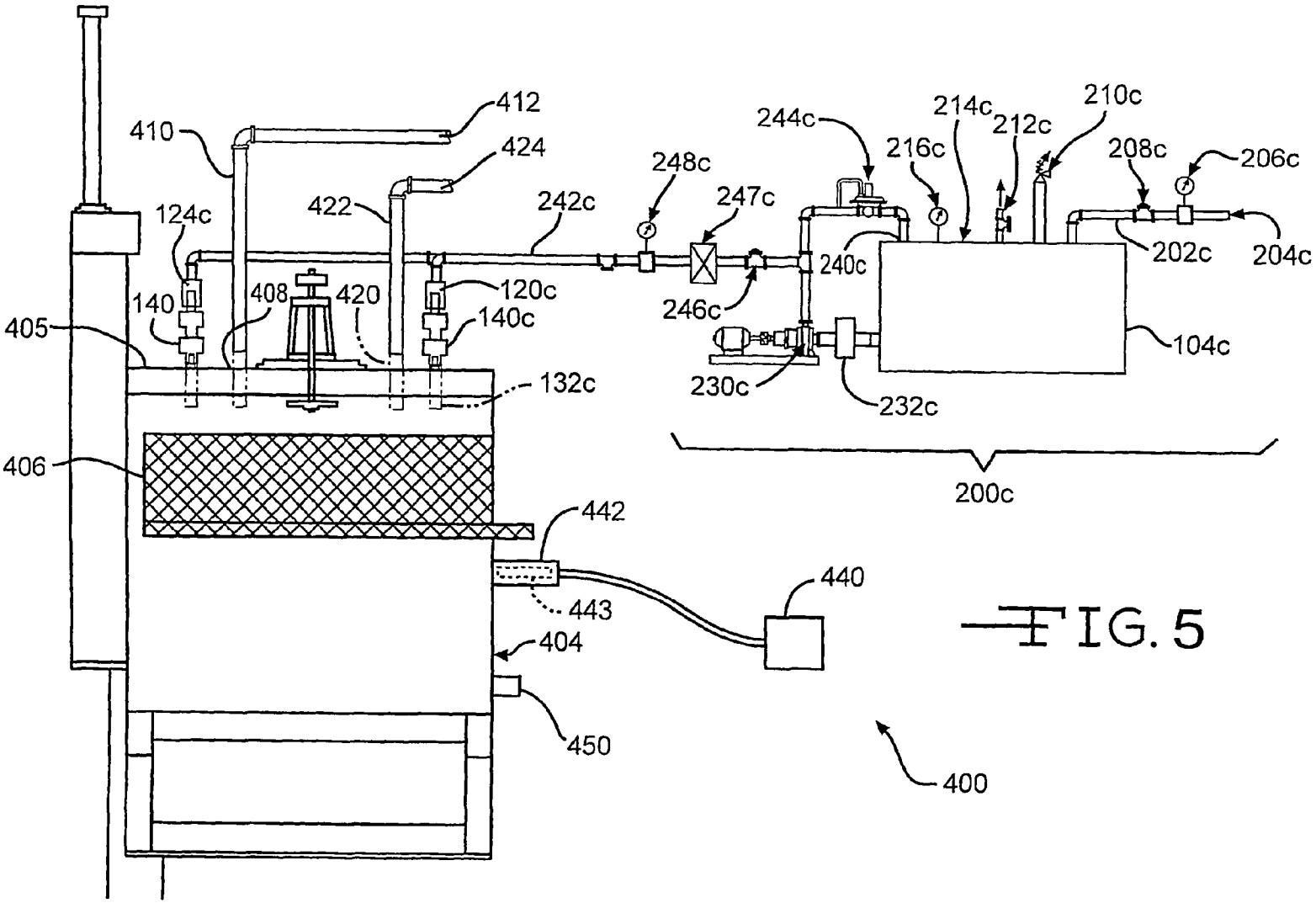
FIG. 5 is a schematic illustration of a liquid hydrocarbon nitrogen carrier system.
Figure 6:
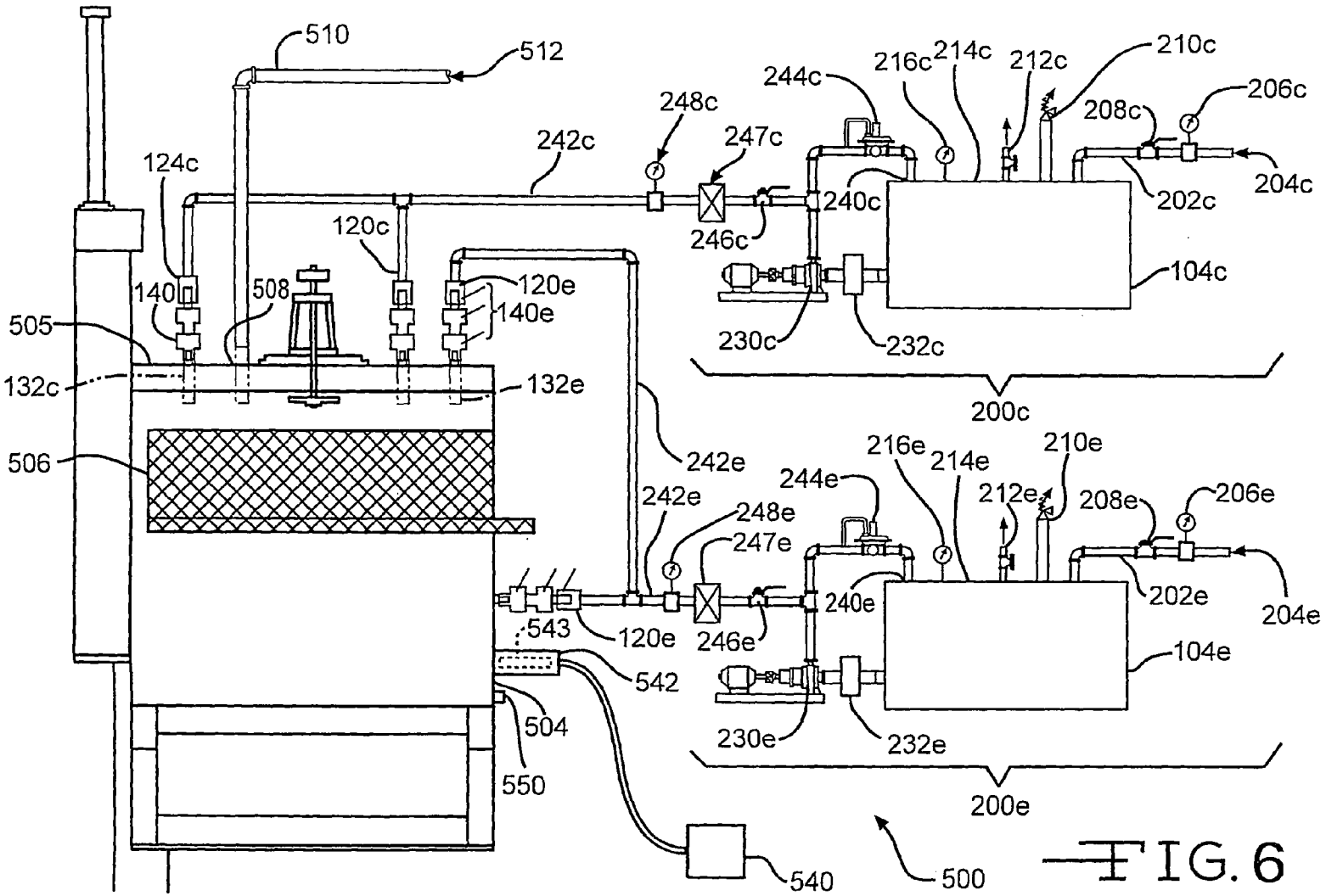
FIG. 6 is a schematic illustration of liquid hydrocarbon nitrogen enrichment and carrier system.

Referring now to FIGS. 4 through 6, various embodiments of the generators as well as enrichment systems, carrier systems, and atmospheres for the atmosphere furnaces are shown.

Figure 2:
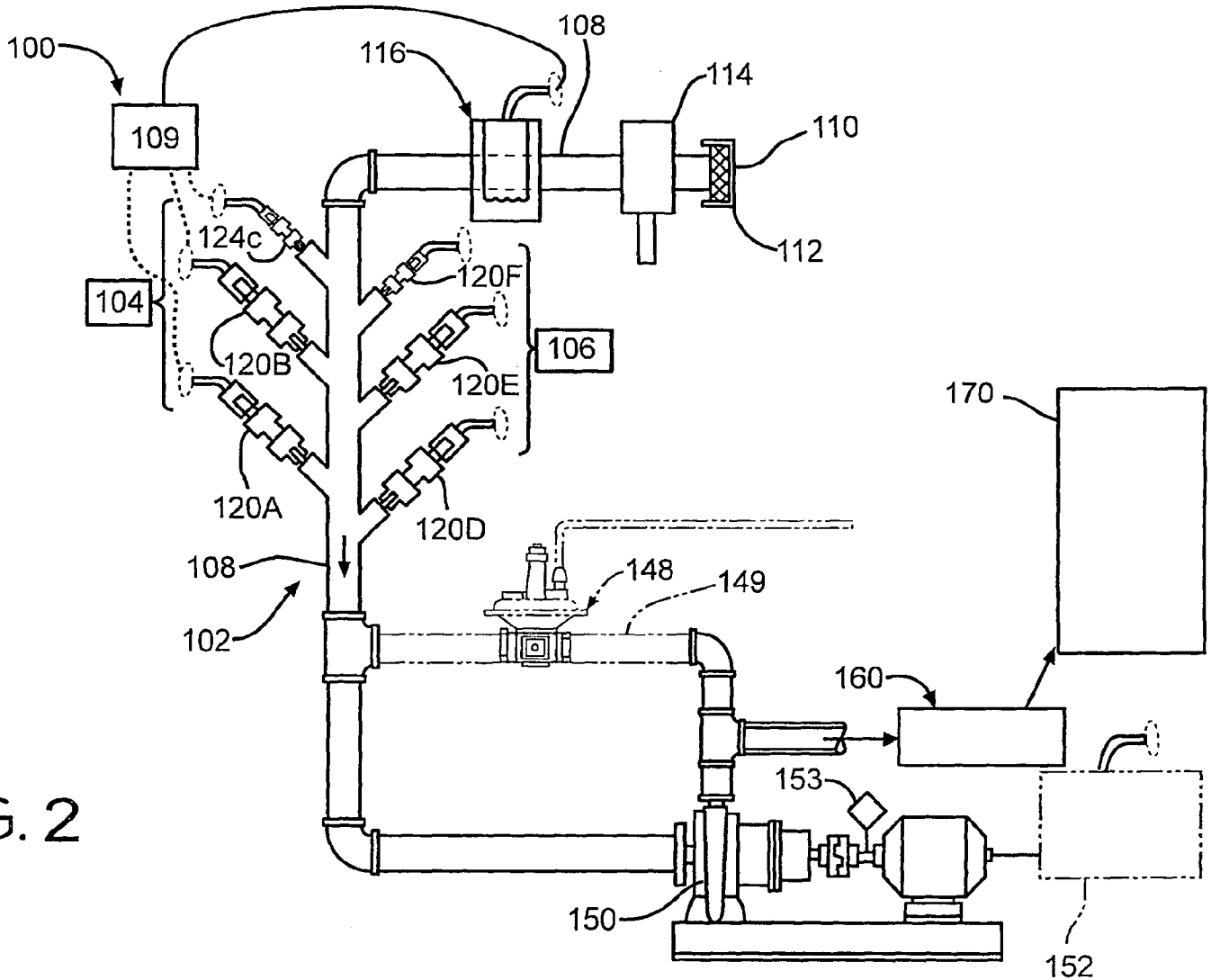
FIG. 2 is a schematic illustration of a generator with a multi-injector arrangement.

FIG. 2 is a schematic illustration of a generator 100 with a multi-injector arrangement 102 for supporting two independent liquids. The multi-injector arrangement 102 is operatively connected to a first tank 104 and a second tank 106, a supply conduit 108, an air inlet 110 with an air filter 112, and a flowmeter 114. Downstream of the flowmeter 114 is a mass air flowmeter 116.

In the embodiment in FIG. 2, the first tank 104 is operatively connected to a plurality of injectors: a first primary injector 120-A, a second primary injector 120-B, and a first trim injector 124-C.

Likewise, the second tank 106 is operatively connected to a plurality of injectors: a first primary injector 120-D, a second primary injector 120-E, and a first trim injector 124-F. It should be understood that, in certain embodiments, the generator can include only one tank having one or more injectors, or multiple tanks having one or more injectors. Each of the injectors 120-A, 120-B, 120-D and 120-E is operatively connected to the supply conduit 108.

The embodiment shown in FIG. 2 is designed for multiple liquids where two sets of three injectors are implemented to mix multiple liquids. Multiple liquids can also be mixed in a storage tank if they are miscible with each other. If nonmiscible, the injector assembly 102 can blend the liquids after they are injected into the supply conduit 108.

The mass air flowmeter 116 is operatively connected to a control device 109 such as a computer such that the mass air flowmeter 116 relates to the control device 109 how much air is flowing through the supply conduit 108. The control device 109 is operatively connected to each injector 120 such that each injector 120 is independently controlled and operated to inject the appropriate amount of hydrocarbon material.

In certain embodiments, the primary injectors 120 are time staggered to allow better mixing of the hydrocarbon material into the air stream. The trim injectors 124 are useful for fine-tuning of the hydrocarbon material being delivered into the air stream within the supply conduit 108 mixture. It is contemplated that the trim injectors 124 have a lesser pounds/hour capability than the primary injectors 120.

The generator 100 also includes a regulator 148 operatively connected to a sense line 149 and a pump 150. In certain embodiments, the pump 150 is connected to a sensor 153 and to a variable frequency drive 152 to raise or lower the generator output. In certain embodiments, the sensor 153 can be a shaft rotation pick up that determines the pump speed. In variable frequency drive applications, the injectors 120 and 123 are fired at different times, pulses, and/or frequencies. The supply conduit 108 receives metered quantities of hydrocarbon material from the injectors and delivers the hydrocarbon material to a reaction tube, or catalyst bed, 160 and then to a furnace 170.

Figure 3:
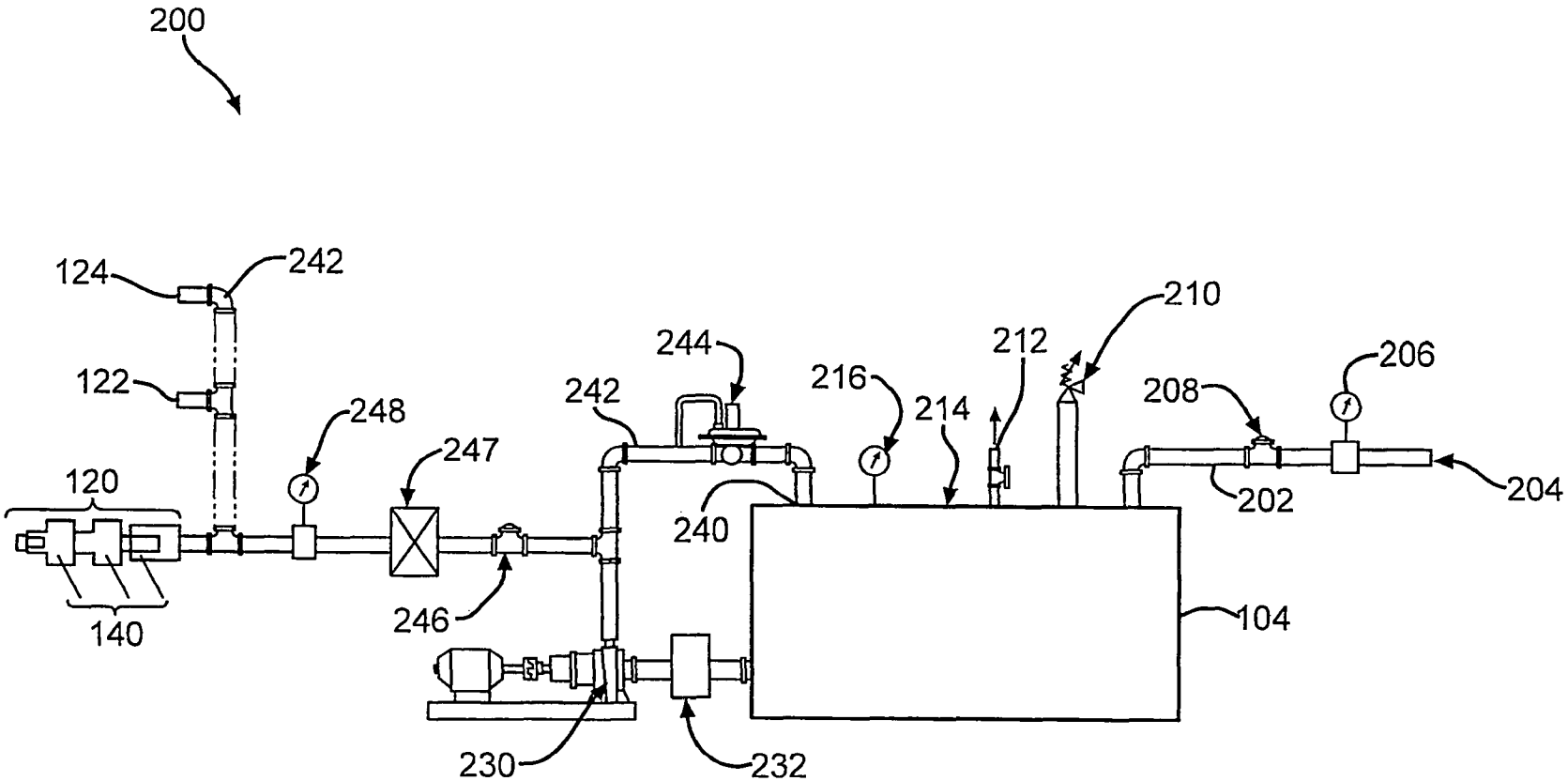
FIG. 3 is a schematic illustration of an injector component system.

FIG. 3 is a schematic illustration of an injection component system 200 for use in delivering liquid material to a furnace (not shown in FIG. 3). For ease of explanation, only one injection component system will be described in detail in conjunction with the embodiment shown in FIG. 3; however, it is to be understood that each injector assembly can be separately connected to similar injection component systems. The injection component system 200 includes the tank 104 operatively connected to one or more injectors, for ease of illustration, one injector 120 is shown.

A conduit 202 delivers a carrier gas such as $N_2$ from a supply 204 at a preferred pressure, such as, for example, 5 psig to the tank 104. Downstream from the carrier $N_2$ supply 204 are a pressure gauge 206 and a shutoff valve 208. The tank 104 can also include a pressure release valve 210, a vent 212, a filling port 214 and a pressure gauge 216.

A pump 230 is operatively connected to the tank 104, and in certain embodiments, a coarse filter 232 can be positioned between the pump 230 and the tank 104. The tank 104 has an exit port 240 that is operatively connected to a delivery conduit 242. A regulator 244 is connected to the delivery conduit 242 for adjusting the amount, volume and/or pressure of the fluid being delivered from the tank 104. Downstream from the regulator 244 is a shutoff valve 246, a fine filter 247 and a pressure gauge 248. The delivery conduit 242 is then operatively connected to each injector 120 (and, the trim injectors 124 when used). In the embodiment shown one heater 140 is operatively connected to the injector 120.

FIG. 4 is a schematic illustration of a liquid enrichment system 300 for an atmosphere furnace 304 where the hydrocarbon material is used to raise or lower carbon potential.

In the embodiment shown in FIG. 4 the liquid enrichment system 300 includes an injection component system 200 substantially as shown in FIG. 3; however, it should be understood that in other embodiments, other configurations of liquid injection systems are useful. For ease of explanation herein, the similar components will have the same reference numbers as shown in FIG. 3. As such, an enrichment injection component system 200*e* will deliver an enrichment gas comprising one or more hydrocarbon materials. For ease of explanation, only one injection component system 200*e* will be described in detail in conjunction with the embodiment shown in FIG. 4; however, it is to be understood that each injector assembly can be separately connected to similar injection component systems. The injection component system 200*e* includes a tank 104*e* operatively connected to the plurality of injectors: a first primary injector 120-*Ae*, and a first trim injector 124-*Ce*.

A conduit 202*e* delivers the enrichment gas from a supply 204*e* at a preferred pressure, to the tank 104*e*. Downstream from the supply 204*e* are a pressure gauge 206*e* and a shutoff valve 208*e*. The tank 104*e* can also include a pressure release valve 210*e*, a vent 212*e*, a filling port 214*e* and a pressure gauge 216*e*.

A pump 230*e* is operatively connected to the tank 104*e*, and in certain embodiments, a coarse filter 232*e* can be positioned between the pump 230*e* and the tank 104*e*. The tank 104*e* has an exit port 240*e* that is operatively connected to a delivery conduit 242*e*. A regulator 244*e* is connected to the delivery conduit 242*e* for adjusting the amount, volume and/or pressure of the fluid being delivered from the tank 104*e*. Downstream from the regulator 244*e* is a shutoff valve 246*e*, a fine filter 247*e* and a pressure gauge 248*e*. The delivery conduit 242*e* is then operatively connected to the first primary injector 120*e* and the first trim injector 124*e*.

The liquid injection system 200*e* is shown operatively connected to the furnace 304 where the injector assembly 120*e* is connected to a roof 305 of the furnace 304. It is to be understood that the desired location of each injector 120 and/124 on the furnace 304 will differ for each end-use application. In one embodiment, the injectors supply an enrichment gas to a center or suction side of a recirculation fan of the furnace 304. In FIG. 4, the injector is shown in the downstream side of the furnace 304.

The furnace 304 includes an article transporter 306. The furnace 304 includes a carrier gas inlet 308 that is operatively connected via a conduit 310 to a carrier gas system 312. The carrier gas system 312 can be a conventional type generator system which delivers a Class "302" atmospheric gas. In other embodiments, the carrier gas system 312 can be similar to the generator system 100 as shown in FIG. 2.

In certain embodiments, a hydrogen-metering device 342 is connected to a supply of hydrogen gas 340 and adapted to meter hydrogen gas into the furnace chamber as the hydrocarbon material is introduced into the furnace chamber. The hydrogen-metering device can be an injector adapted to injection pulse hydrogen until a desired carburization level is achieved.

Also, in certain embodiments, a hydrogen sensing device 350 can be used to sense the concentration of the hydrogen in the furnace chamber, and vary the flow of at least one of the hydrogen, the hydrocarbon material, or both, in accordance with the sensed concentration of the hydrogen and the methane, or CO to $CO_2$ ratio, or water to hydrogen vapor, or oxygen to CO ratio.

E. FURNACE WITHOUT GENERATOR

FIG. 5 is a schematic illustration of a liquid hydrocarbon-nitrogen carrier system 400 for an atmospheric furnace 404. Again, for ease of explanation, similar components as shown in other figures will be shown with the same reference numbers. It is to be understood that each injector assembly can be separately connected to similar injection component systems. As such, FIG. 5 is a schematic illustration of a liquid "hydrocarbon nitrogen" carrier system 400 for an atmosphere furnace 404 where the "hydrocarbon nitrogen" carrier material is used to raise or lower carbon potential.

In the embodiment shown in FIG. 5 the liquid enrichment system 400 includes a carrier injection component system 200*c* substantially as shown in FIG. 3; however, it should be understood that in other embodiments, other configurations of liquid injection systems are useful. For ease of explanation herein, the similar components will have the same reference numbers as shown in FIG. 3. For ease of explanation, only one injection component system 200*c* will be described in detail in conjunction with the embodiment shown in FIG. 5; however, it is to be understood that each injector assembly can be separately connected to similar injection component systems. The injection component system 200*c* includes the tank 104*c* operatively connected to one or more of injectors, and for ease of illustration, a first primary injector 120*c*, and a first trim injector 124*c* are shown.

A conduit 202*c* delivers a carrier gas such as $N_2$ from a supply 204*c* at a preferred pressure, such as, for example, 5 psig to the tank 104*c*. Downstream from the carrier $N_2$ supply 204 are a pressure gauge 206*c* and a shutoff valve 208*c*. The tank 104*c* can also include a pressure release valve 210*c*, a vent 212*c*, a filling port 214*c* and a pressure gauge 216*c*.

A pump 230*c* is operatively connected to the tank 104*c*, and in certain embodiments, a coarse filter 232*c* can be positioned between the pump 230*c* and the tank 104*c*. The tank 104*c* has an exit port 240*c* that is operatively connected to a delivery conduit 242*c*. A regulator 244*c* is connected to the delivery conduit 242*c* for adjusting the amount, volume and/or pressure of the fluid being delivered from the tank 104*c*. Downstream from the regulator 244*c* is a shutoff valve 246*c*, a fine filter 247*c* and a pressure gauge 248*c*. The delivery conduit 242*c* is then operatively connected to the first primary injector 120*c* and the trim injector 124*c*.

In certain embodiments, a hydrogen metering device 442 is connected to a supply of hydrogen gas 440 and adapted to meter hydrogen gas into the furnace chamber 404 as the hydrocarbon material is introduced into the furnace chamber 404. The hydrogen metering device can also be an injector type device that is adapted to injection pulse hydrogen until a desired carburization level is achieved. In certain embodiments, the hydrogen metering device 442 can include an expansion chamber 443.

Also, in certain embodiments, a hydrogen sensing device 450 can be used to sense the concentration of the hydrogen in the furnace chamber. The flow of at least one of the hydrogen, the hydrocarbon material, or both, can then be varied in accordance with the sensed concentration of the hydrogen and the methane, or CO to $CO_2$ ratio, or water to hydrogen vapor, or oxygen to CO ratio.

FIG. 5 shows the use of injectors to create an equivalent "Class 302" atmosphere in the furnace such that a generator is not required. Thus, the carrier nitrogen gas along with liquid injection is used where the carbon potential enrichment material is the hydrocarbon material. The furnace 404 includes an article transporter 406. The furnace 404 is connected to a carrier gas controller 408 that is operatively connected to a roof 405 of the furnace. The carrier gas controller 408 is operatively connected via a conduit 410 to a carrier gas system 412. Thus, the carrier system replaces a conventional type generator system that had been used in the past to deliver a "Class 302" atmospheric gas. Thus, in one aspect of the present invention, an equivalent "Class 302" gas is made directly in the furnace using nitrogen gas and the hydrocarbon material which, in turn, dissociates in the furnace to form $H_2$ and CO.

It is to be noted that, in certain embodiments, the furnace 404 can have an enrichment gas inlet 420 that is operatively connected via a conduit 422 to an enrichment gas system 424. The enrichment gas system 424 can be a conventional type enrichment system. In another embodiment, the enrichment gas system 424 can be similar to the enrichment system 300 as shown in FIG. 4.

In the embodiment shown in FIG. 5, the injector(s) 120 and/or 124 accurately control extremely small liquid flows; for example, a 0.1 ml pulse per second pulse. When a higher or lower flow rate is needed, the pulse width of the injector is changed; for example, by using a computer control. The injector(s) 120/124 atomize the hydrocarbon material into a spray of fine liquid particles. Upon flowing into the furnace, heat which is typically above 1400° F., causes the atomized particles to readily vaporize.

Due to the low cost of the injector, more than one injector can be used. For example, one large injector and one small injector can be used, where the small injector serves as a redundant backup to the larger injector and can perform a "trim" adjustment function, biased by a carbon monoxide analyzer, if desired.

F. COMBINED SYSTEM HAVING CARRIER SYSTEM AND ENRICHMENT SYSTEM

FIG. 6 is a schematic illustration showing a combined system 500 showing both a carrier system 200*c* and the enrichment system 200*e* for an atmosphere furnace 504 where the hydrocarbon material is used to raise or lower carbon potential. For ease of explanation herein, the similar components will have the same reference numbers as shown in FIG. 4. As such, the enrichment injection component system 200*e* is useful for use in delivering an enrichment gas comprising one or more carburizing materials. For ease of explanation, only one injection component system 200*e* will be described in detail in conjunction with the embodiment shown in FIG. 6; however, it is to be understood that each injector assembly can be separately connected to similar injection component systems. The injection component system 200*e* includes the tank 104*e* operatively connected to the plurality of injectors: the first primary injector 120*e*, and the first trim injector 124*e*.

A conduit 202*e* delivers the enrichment gas from a supply 204*e* at a preferred pressure, to the tank 104*e*. Downstream from the supply 204*e* is a pressure gauge 206*e* and a shutoff valve 208*e*. The tank 104*e* can also include a pressure release valve 210*e*, a vent 212*e*, a filling port 214*e* and a pressure gauge 216*e*.

A pump 230*e* is operatively connected to the tank 104*e*, and in certain embodiments, a coarse filter 232*e* can be positioned between the pump 230*e* and the tank 104*e*. The tank 104*e* has an exit port 240*e* that is operatively connected to a delivery conduit 242*e*. A regulator 244*e* is connected to the delivery conduit 242*e* for adjusting the amount, volume and/or pressure of the fluid being delivered from the tank 104*e*. Downstream from the regulator 244*e* are a shutoff valve 246*e*, a fine filter 247*e* and a pressure gauge 248*e*. The delivery conduit 242*e* is then operatively connected to the first primary injector 120*e* and the first trim injector 124*e*.

The liquid injection system 200 is shown operatively connected to the furnace 504 where the injector assembly 120*e* is connected to a roof 505 of the furnace 504. It is to be understood that the desired location of each injector assembly on the furnace 504 will differ for each end-use application.

The furnace 504 includes an article transporter 506. The furnace 504 includes a carrier gas inlet 508 that is operatively connected via a conduit 510 to a carrier gas system 512. In certain embodiments, the carrier gas system 512 can be a conventional type generator system which delivers a Class "302" atmospheric gas. In other embodiments, the carrier gas system 512 can be similar to the generator system 100 as shown in FIG. 2.

In certain embodiments, a hydrogen metering device 542 is connected to a supply of hydrogen gas 540 and adapted to meter hydrogen gas into the furnace chamber 504 as the hydrocarbon material is introduced into the furnace chamber. The hydrogen metering device 542 can be an injector-type device that is adapted to injection pulse hydrogen until a desired hydrogen level is achieved.

Also, in certain embodiments, a hydrogen sensing device 550 can be used to sense the concentration of the hydrogen in the furnace chamber 504, and vary the flow of at least one of the hydrogen, the hydrocarbon material, or both, in accordance with the sensed concentration of the hydrogen and the hydrocarbon materials.

In the embodiment shown in FIG. 6 the carrier injection component system 200*c* is substantially as shown in FIG. 4; however, it should be understood that in other embodiments, other configurations of liquid injection systems are useful. For ease of explanation herein, the similar components will have the same reference numbers as shown in FIG. 4.

As such, the injection component system 200*c* for use in delivering an enrichment gas comprises one or more carburizing materials. For ease of explanation, only one injection component system 200*c* will be described in detail in conjunction with the embodiment shown in FIG. 6; however, it is to be understood that each injector assembly can be separately connected to similar injection component systems. The injection component system 200*c* includes the tank 104*c* operatively connected to the plurality of injectors: the first primary injector 120*c*, and the first trim injector 124*c*.

A conduit 202*c* delivers a carrier gas such as $N_2$ from a supply 204*c* at a preferred pressure, such as, for example, 5 psig to the tank 104*c*. Downstream from the carrier $N_2$ supply 204 are a pressure gauge 206*c* and a shutoff valve 208*c*. The tank 104*c* can also include a pressure release valve 210*c*, a vent 212*c*, a filling port 214*c* and a pressure gauge 216*c*.

A pump 230*c* is operatively connected to the tank 104*c*, and in certain embodiments, a coarse filter 232*c* can be positioned between the pump 230*c* and the tank 104*c*. The tank 104*c* has an exit port 240*c* that is operatively connected to a delivery conduit 242*c*. A regulator 244*c* is connected to the delivery conduit 242*c* for adjusting the amount, volume and/or pressure of the fluid being delivered from the tank 104*c*. Downstream from the regulator 244*c* is a shutoff valve 246*c*, a fine filter 247*c* and a pressure gauge 248*c*. The delivery conduit 242*c* is then operatively connected to the first primary injector 120*c* and the second primary injector 120*c*.

FIG. 6 also shows the use of injectors to create an equivalent "302" atmosphere in the furnace such that a generator is not required. Nitrogen gas along with liquid injection is used where the carbon potential enrichment is a hydrocarbon.

In other embodiments, the furnace 504 further can include a carrier gas controller 510 that is operatively connected via a conduit 512 to a carrier gas system 514. Thus, in certain embodiments, the carrier gas system 514 can be a conventional type generator system which delivers a Class "302" atmospheric gas. In other embodiments, the carrier gas system 514 can be similar to the generator system 100 as generally shown in FIG. 2.

G. EXAMPLES

The following non limiting examples show tests which have been conducted at different temperatures and carbon potentials with and without different hydrogen and CO levels that are within the contemplated scope of the present invention.

It is to be understood that the hydrocarbon material forms CO and decreases $CO_2$ levels. The hydrocarbon material also forms hydrogen and lowers dew point levels. In various embodiments, the hydrogen level can be greater than the CO level; in other embodiments, less than the CO level; and in still other embodiments, about equal to the CO level.

It is also to be understood that it is within the contemplated scope of the present invention that one or more hydrocarbons from a family or from multiple families are useful in the present invention. In certain embodiments, air is added to the furnace to achieve partial oxidation in the furnace. For example, air is added when the carrier material comprises acetone. In other embodiments, nitrogen is added; for example when the carrier material includes methanol. In other embodiments, air and nitrogen are added together to achieve an oxygen level below 21%.

Also, while in certain embodiments, an injector would normally not be used for air or nitrogen, an injector would be used for a liquid. For example, in the case of liquefied propane or butane, there could be a direct injection of the liquid propane or butane without first letting the propane or butane become a gas. Alternatively, the carrier system includes allowing the liquefied propane or butane to become a gas.

Example 1

Test Carbon Bar

Several tests were conducted on the direct injection of liquid hydrocarbons into a furnace and also an endothermic generator. Metallurgical tests were conducted on a test pin or carbon bar. The test pin is made from 8620 material with a typical good grade of carburizing steel. A 8620 material is one of the most typical good grades of steel. This is also a standard material for all carbon bars (test pins). It has 0.2% molybdenum, 0.5% chrome, 0.5% nickel and balance iron. The higher the alloy compounds, the easier the material is to oil quench. When the alloy components are much higher (typically 1% to 3%), high pressure gas quenching is possible.

An atmosphere was generated in an endothermic gas generator using a cyclohexane and air mixture. This is a partial oxidation atmosphere, so the amount of air is greatly reduced over the amount of air that would be used for normal combustion.

An injector assembly was mounted upstream of a mixture pump that drew outside room air through an air filter and into the air stream. Cyclohexane liquid was sprayed using a GM Multec 2 injector. Initially, the injector was fitted without a heater, but after some operating time, the inlet feed pipe became cold and there was an initial concern that the cyclohexane might begin to freeze. A heater was fitted onto the system. It is to be understood that in commercially installed generator configurations, there would be no need for an electric heater since typically there is an abundance of free heat available that could be intermingled with the pipe the liquid spray is dispersed within.

Figure 7:
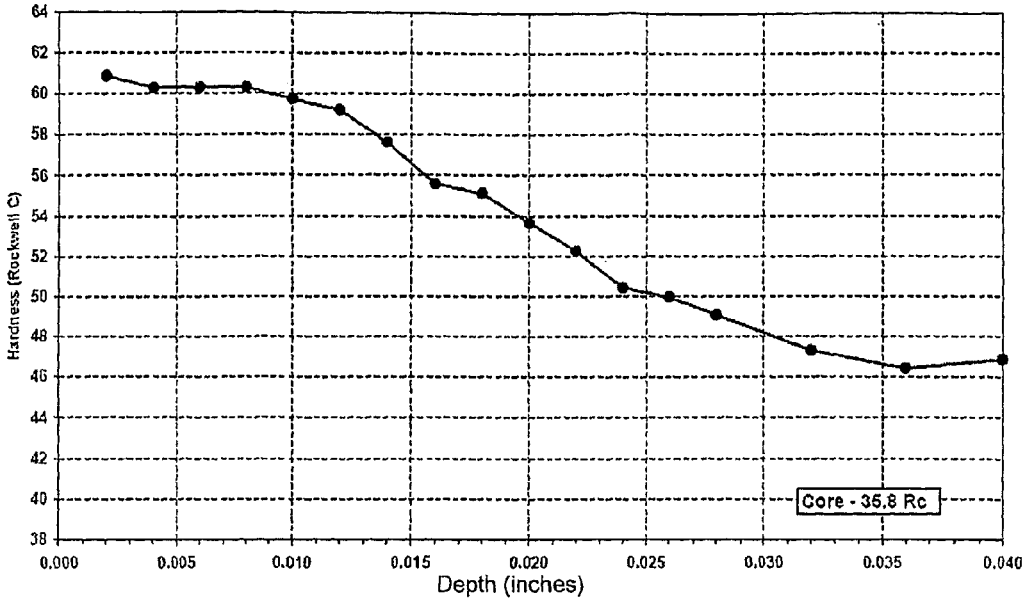
FIG. 7 is a graph showing the Rockwell hardness for a test bar.

Referring now to FIG. 7, the results for the Test Carbon Bar are illustrated in a graph that shows the carburized case depth hardness at increasing depths of the Test Carbon Bar. The hardness, as measured with a micro hardness test, had a Rockwell Hardness (RC) of 61 on the surface. In certain embodiments a Rockwell Hardness score of 60 is considered good and 61 is better for certain materials; while a score below 57 RC, for example, could be considered slightly off hardness. Now, moving to the right, there is a strong 60 RC profile that continues until 0.010" until it begins to fall. This plateau is also considered desirable and indicates that the article is just as hard through a depth of 0.010" as it is on the surface.

The effective case depth for the Test Bar is at the point the hardness has diminished to 50 RC. While the range of 51 or 49 RC is sometimes used as a measure, a 50 RC is basically the standard. At 50 RC, there is an Effective Case Depth "ECD" of 0.025". This met the target results desired which was especially surprising since this was the first test run.

The "Total Case Depth" for this test bar is about 0.032". Total is defined as the point at which base hardness of the material begins to rise up. A comparison test pin with carburization would have about 45 to 46 RC as can be seen at the far right. Referring now to the left at 0.040" the effects of carbon put into the steel starts to raise hardness at about 0.032" or so.

Example 2

Gear Test

Metallurgical tests were conducted on a gear article. An atmosphere was generated in an endothermic gas generator using a cyclohexane and air mixture. This is a partial oxidation atmosphere, so the amount of air is greatly reduced over the amount of air that would be used for normal combustion.

Figure 8:
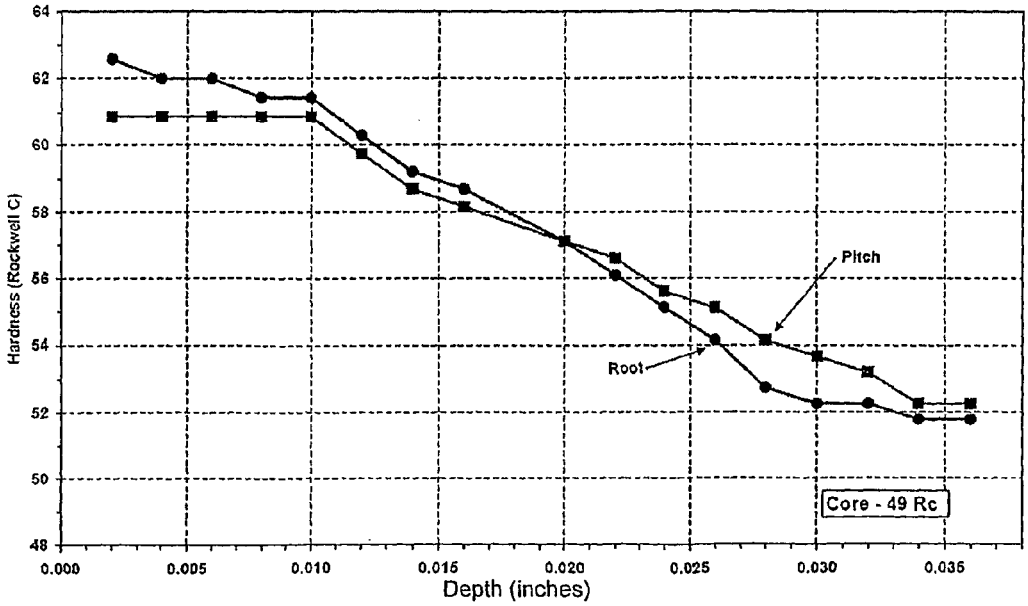
FIG. 8 is a graph showing the Rockwell hardness for a test gear.

Referring now to FIG. 8, two hardness profiles are shown. The gear is comprised of a material that has more of the alloy components. Because of this its base hardness is very high at 49 RC, therefore the 50 RC measuring point is skewed up to about 54 RC. Looking at the shapes of the graph, there is a flat plateau again at 61 and 62 RC for 0.010", then the gradual slope down to base hardness.

The "Pitch" line is then defined as half way up the flat of the gear tooth. The "Root" is in the valley between gear teeth. Typically, the root will have substantially lower case depth as compared to the Pitch line; sometimes only half the case depth. When the depth is examined at the 54 RC case depth, the depth is 0.026" for the root and the depth is 0.028" for the pitch. Dividing the two numbers shows a root/pitch ratio of 92.8% which is greatly desired. Also, when the different case depths are examined, the hardnesses are very close.

Metallurgically, the case was a good tempered martensite. In the tempered martensite, there were finely dispersed carbides and no carbide networking. Also in the case, retained austenite was below 5%. These are all very desirable metallurgical results.

The core properties were a mixture of martensite, bainite, and ferrite. This reflects the quenching and not the carburizing. The core properties are a metallurgical requirement and also described here for that purpose. The carbon profile is a measurement taken at various case depths from the surface down to the core.

The procedure is performed by turning shavings of steel from the test sample and burning them in a LECO® Carbon Determinator or analyzer. The amount of carbon picked up throughout the case through diffusion will burn and elevate the temperature of the sample. Depending on the elevation in temperature, the amount of carbon can be determined. The surface will be the highest and it will slope down progressively. It will track the hardness. More carbon means more hardness. Typical carbon levels on the surface are 0.80 to 1.00% weight carbon. A result of 0.78% for gears would be desirable since gears are harder to effectively carburize since the tips of the teeth can get too much carbon and be too hard. Too much carbon can lead to higher levels of retained austenite or potential carbides, which are sometimes not desired. Both are by-products of carbon levels that are too high.

The carrier gas going to the furnace for this example was made from cyclohexane liquid pressurized with a nitrogen supply of 30 psig. The liquid cyclohexane $C_6H_{12}$ was gated into the suction side of the mixture pump through the injector. The pump puts a negative pressure on the order of 7" to 28" water column and enhances the vaporization of the injected liquid. The generator was adjusted to manufacture 900 cubic feet per hour of low hydrogen, high CO atmosphere.

One benefit of this design is that liquid cyclohexane comes in a commercial grade of 99.9% since supplies of commercial hydrocarbon such as propane or natural gas often have impurities such as $CO_2$, sulfur, and the like which can cause problems. Also it is common for the hydrocarbon content itself to vary which also causes problems.

Example 3

Measurement of Carbon Potential

The prepared carrier was fed to a Surface Combustion® batch integral quench furnace. While 900 cfh of gas was manufactured, however the furnace only required 300 cfh of endothermic gas. The carbon potential desired in the furnace was maintained to 0.78% carbon. The measured carbon potential was slightly lower and ½ to 1.0 cfh of methane was added to raise the carbon potential to 0.78%. In another portion of this embodiment, cyclohexane vapor was added directly to the furnace to control the carbon potential.

Measured carrier gas using Siemens three gas ULTRAMAT 23® infrared gas analyzer indicted the cyclohexane produced carrier was 0.225% $CO_2$, 24.0 CO, 0.01% methane. It was estimated that the hydrogen level was 24% to 25% and the nitrogen level was about 50%. Later residual gas analysis indicates $H_2$ and $N_2$ are as expected Example 4

Cycling of Injector

The injector on the endogenerator was programmed to fire 5.23 times per second for a total period of 190 milliseconds. The on-time was adjusted to vary the air mixture. During processing, the on time was 62 millisecond; the off time was 128 millisecond. The duty cycle was 32.6%. The injector is capable of supplying 28 pounds per hour.

Example 5

Multiple Injectors

In certain embodiments, two or more injectors are useful. One main injector of higher pounds per hour provides the bulk of the hydrocarbons, while a second smaller injector provides trim for various flow requirements. Duty cycle controls are useful to match the correct amount of hydrocarbons to a given air flow. The injectors can be configured to fire alternately to yield a more continuous stream of hydrocarbon materials. With multiple injectors, a continuous stream of cyclohexane or hydrocarbon is readily accomplished. The control of the "overlap" allows increases or decreases to be made without an interruption to the flow.

Example 6

Enrichment with Cyclohexane

The first trial was the use of cyclohexane for the enrichment material. Enrichment pulse widths were on the order of 20 milliseconds every second. Inlet cyclohexane pressure to the injector was set to 30 psig. The injector was mounted to the side of the furnace and injected as a spray mist of cyclohexane into the furnace. In other embodiments, the injector can also be located on the roof of the furnace.

In this example, the carrier gas was endothermic gas generated from methane. It is to be understood, however, that endothermic gas generated from cyclohexane could also easily be used. The injection of cyclohexane was initially started at 20 milliseconds. This was a duty cycle of 2%. Control was accurate and extremely smooth. Also noted was that CO levels did not fall much as is typical with methane using cyclohexane, and, in fact, even increased slightly to almost 21% using toluene and acetone.

Carbon content of the atmosphere was determined by monitoring with an oxygen probe and also an infrared three gas analyzer measuring CO, $CO_2$, and methane. Carbon potential was calculated using applicants $CO/CO_2$ carbon equation. Results from the carbon calculation correlated extremely close to those of thin shim stock exposure to the atmosphere and then burned in a LECO® Carbon Determinator.

An actual value for $CO_2$ was 0.080%, CO, 19.2%, and methane 0.01%.

Applicant's equation 9A calculated 1.21% carbon and shim stock results were 1.29% carbon. This was considered very good for the first test using the injector.

Example 7

Seasoning of Furnace

The furnace was degassed and exposed to air which removed most carbon from the furnace internals. Following a burnout, the furnace was gassed with endothermic atmosphere and carbon potential was 0.07% indicating a furnace which needed to be "seasoned". Cyclohexane was injected at a high pulse with of approximately 200 milliseconds.

The furnace reached carbon potential of 1.00% in approximately 2 minutes. This is a very short period of time as compared with enriching with methane. Following the seasoning process, similar tests as described above were conducted and repeated the same results.

Example 8

Injection with Acetone

The injection fluid was changed from cyclohexane to acetone. Actual values for $CO_2$ was 0.140%, CO was 21.1% and methane 0.01%. Applicant's equation calculated 0.883% Carbon and shim stock results as measured by the LEECO® Carbon Determinator were 0.872% carbon. Enrichment liquid was acetone.

Example 9

Injection with Toluene

On a third trial, the furnace was enriched with toluene in place of cyclohexane or acetone. An actual value for $CO_2$ was 0.120%, CO was 21.1%, and methane was 0.01%. There was a calculated 1.010% Carbon and shim stock results were 1.000% carbon based on toluene.

Example 10

In Situ Injected Atmosphere

The injector is also useful to provide an in situ atmosphere using methanol and nitrogen balance. Injector eliminates both of the problems of plugged or failed sparger and/or inconsistent liquid flow controls.

First, the injector meters accurately very low flow levels; thus, maintaining exactly one gallon per hour, or any other desired set point, is readily achievable.

Second, there are no spargers to plug up. The nozzle of the injector is back where the furnace is cold and carbon drop out cannot occur on the tip of the probe.

Likewise, the methanol is presented to the injector in fluid communication at a pressure of 30 to 45 psig and therefore is unlikely to plug. Such drop systems have low pressure at the sparger.

Example 11

Cyclohexane

Figure 9:
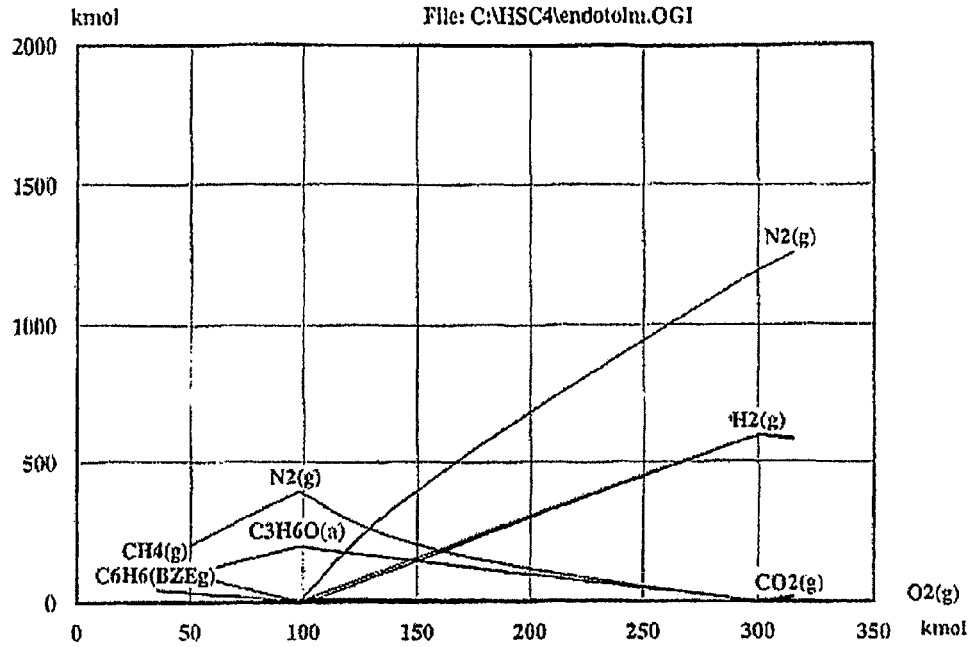
FIG. 9 is a HSC graph showing, in pounds (kmol v. kmol), for cyclohexane.

FIG. 9 shows that at the partial oxidation level, CO levels are approximately 25% and hydrogen levels are the same. Nitrogen is on the order of 50%. There are trace levels of $CO_2$ and water vapor. For FIGS. 9 and 10, the parameters were as follows for the formation of Gas at 1000° C.: Temperature at 1273.150° K, Pressure at 1.000 bar, Raw materials—kmol, and $C_6H_6$(BZEg)=5.0000E−02
$C_7H_8$(CHAg)=9.9000E+01
$C_7H_8$ (TLUg)=5.0000E−01
$C_3H_6O$(a)=5.0000E−02
$CH_4$=1.0000E−02
$CH_3OC$(l)=5.0000E−01
$O_2$(g)−3.5000E+01
$N_2$(g)−1.4000E+02.

Figure 10:
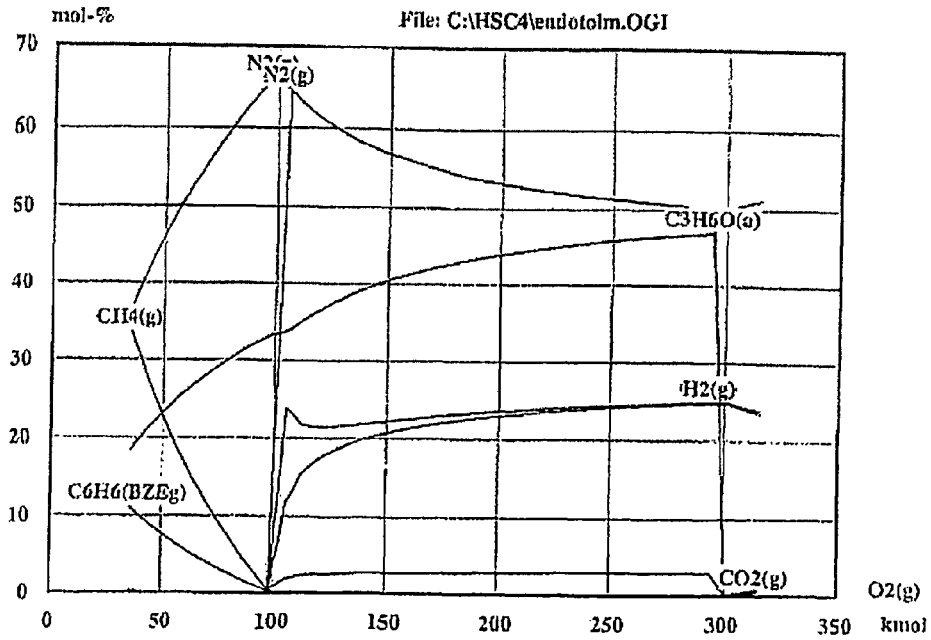
FIG. 10 is a HSC graph showing, in moles (mol % v kmol), for cyclohexane.

FIG. 9 is presented in percentages, while FIG. 10 is presented in pound moles. For FIG. 10, the parameters were as follows for the formation of Gas at 1000° C.:

The horizontal axis is air. Both nitrogen and oxygen were pumped in. Oxygen is estimated at only 20% instead of 20.9% since it was easier to calculate. When the graph is examined just past 300 mol of oxygen, this is a normal operating parameter. It is at the point where small amounts of $CO_2$ occur. At this point there is 25% CO and 25% $H_2$. The CO trace is hidden behind the $H_2$ trace. Nitrogen level is 50%.

An additional benefit is the higher than normal CO level and the lower than normal hydrogen level which also aids in preventing soot formation in the furnace.

Example 12

Blends of Hydrocarbons

Blends of hydrocarbons are also useful as carburizing materials. The chemistry of the product gas can be shifted in regard to nitrogen by changing air additions or with the addition of a hydrocarbon containing oxygen such as methanol, ethanol, acetone, or the like. Likewise, more hydrogen can be obtained with the addition of saturates such as methane (natural gas), propane, butane, or the like. Use of compounds such as cyclohexane, methylcyclohexane, ethylcyclohexane and the like provides mixtures or blends where ratio of CO to hydrogen approaches about 1 to 1. Also, in certain embodiments, by utilizing the unsaturates such as toluene, xylene, and the like, the hydrogen levels can be depressed by the CO levels. Likewise, diesel, toluene, jet fuel, xylene, kerosene, gasoline, acetone, ethylene, methanol, butane, cyclohexane, benzene, and the like are useful as the hydrocarbon for an atmosphere prepared directly in the furnace. In addition to the nitrogen, air can be used for some hydrocarbons.

In other embodiments, atmospheres can be made using the injector with acetone; and, instead of the nitrogen, air can be substituted. Tests show that high CO levels are generated in a period of several minutes. The desired compositions of the blends will depend, at least in article, on the article being carburized.

Example 12A

Premixed Blends of Hydrocarbons

In certain embodiments, a premixed tank supply of different hydrocarbons provides: lower ambient storage temperatures; economical advantages; lower or higher CO levels; lower or higher hydrogen levels for a given CO level; and, lower or higher nitrogen levels.

Example 12B

Blending of Hydrocarbons at Inlet

Multiple injector blending can be accomplished at the inlet of the furnace chamber. In certain embodiments, when it is desired to operate a mixture, multiple storage tanks for feeding multiple injectors, with each injector dedicated to a given feedstock is possible. The ratio of the blend is controlled by the duty cycle of each injector. For example, should less carburizing materials be desired, its injector is decreased in duty cycle, while the alternate injector is increased in duty cycle. Both injectors increase or decrease together as air flow changes require different hydrocarbon flow rates.

Examples 12a-12j

One program which determines the ability of the reaction to occur is available from Outokumpu Research of Finland under the brand name of HSC Chemistry for Windows"™. This program predicts the Gibbs free energy and whether the reaction is likely to occur or not to occur. The program does not determine the speed of the reaction but it is an indication of the magnitude of the reaction which, in turn, is an indication of the probability of the reaction occurring. This program was run for a number of hydrocarbon materials and blends thereon.

Example 12a

Blend of Cyclohexane, Toluene and Methanol

Figure 11:
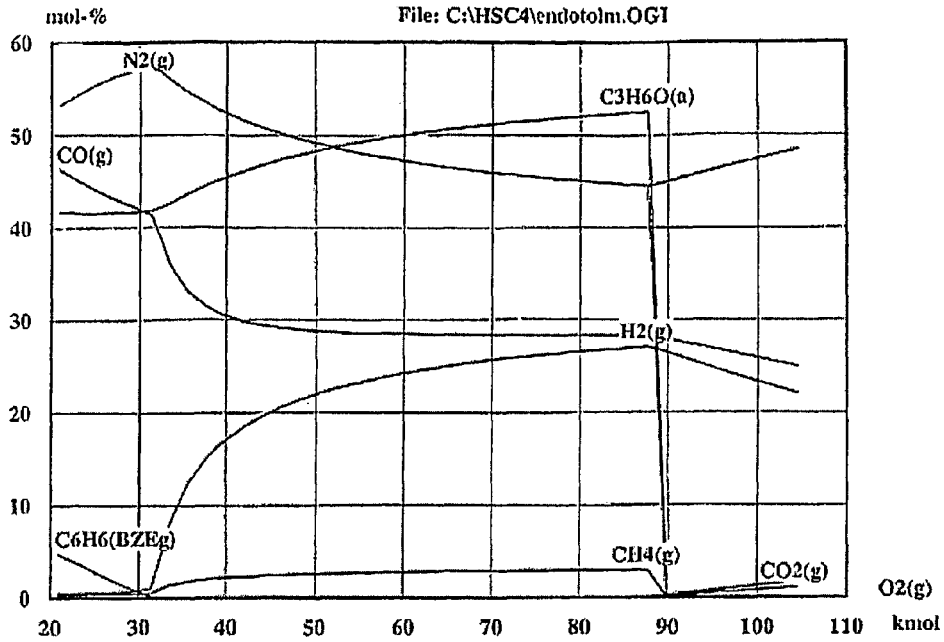
FIG. 11 is a HSC graph showing, in moles (mol % v kmol), for a blend of cyclohexane, toluene and methanol.

A blend was tested using a mixture of methanol, toluene, and cyclohexane. The mixture was comprised of 33% methanol, 33% toluene, and 33% cyclohexane. Referring now to FIG. 11, the HSC graph shows that there are primarily equal amounts inputted for toluene, cyclohexane, and methanol. The parameters were as follows for the formation of Gas at 1000° C.: Temperature at 1273.150° K, Pressure at 1.000 bar, raw materials—kmol, and $C_6H_{12}$(CHAg)=1.5000E+01
$C_6H_6$(BZEg)=5.0000E−02
$C_7H_8$(CHAg)=1.5000E+01
$C_3H_6O$(a)=5.0000E−03
$C_3H_8$(PPEg)=5.0000E−03
$CH_4$=5.0000E−03
$H_2O$=5.0000E+00
$CH_3OC$(l)=1.5000E+01
$O_2$(g)=2.0900E+01
$N_2$(g)=7.8000E+02.

In FIG. 11, the graph slightly to the right of 92 mol oxygen shows where small amounts of $CO_2$ and $H_2O$ are detected, which are often normal operating parameters. The hydrogen level is below the CO level and the nitrogen level has dropped to about 45% down from 50%. The more methanol that is added, the lower the nitrogen; and less air is required for the balance of the atmosphere since methanol has an "onboard", or attached, oxygen. Further, since there is less air, there is less nitrogen in the product.

Also, when unsaturated hydrocarbons such as toluene, xylene, or even benzene are added (since their hydrogen count is half that of cyclohexane) the unsaturated hydrocarbons further lower the hydrogen percentage.

An analysis of the blend by a separate laboratory showed the following chemical mix: Hydrogen=30.4%, oxygen=1.17%, nitrogen=43.3%, CO=24.8%, methane=0.01%, $CO_2$=0.32%. The Siemens Ultramat® analyzer indicated 26.0 CO, 0.39 $CO_2$, and 0.01 Methane.

Example 12b

First Blend of Toluene, Acetone and Methanol

Figure 12:
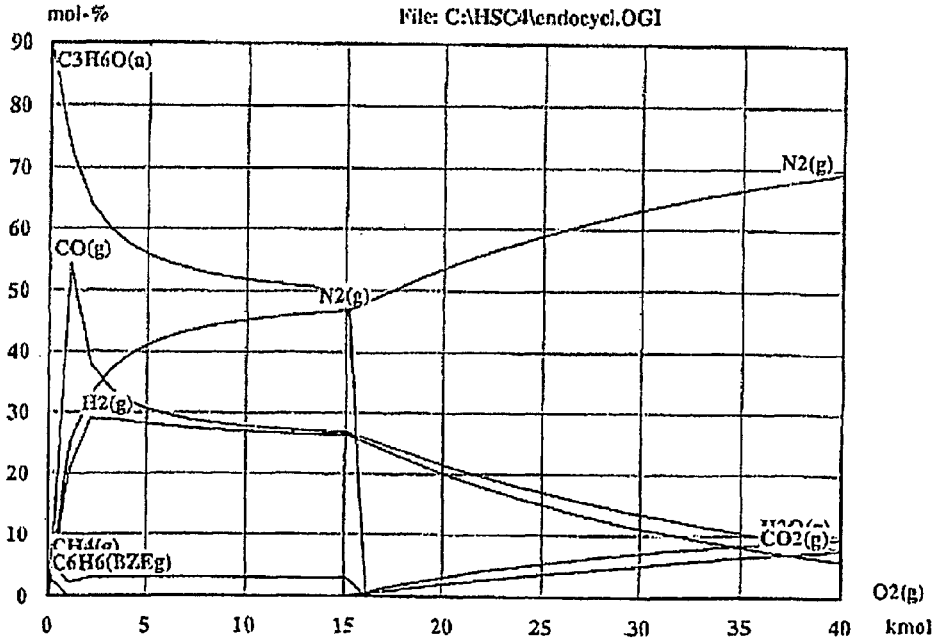
FIG. 12 is a HSC graph showing, in moles (mol % v kmol), for a first blend of acetone, toluene, and methanol.

A first blend was tested using a mixture of toluene, acetone and methanol. The mixture was comprised of about 43% toluene, about 43% acetone, and about 14% methanol, as can be seen by referring to the HSC graph in FIG. 12. The parameters were as follows for the formation of Gas at 1000° C.: Temperature at 1273.150° K., Pressure at 1.000 bar, Raw materials—kmol, and $C_6H_6$(BZEg)=5.0000E−01
$C_7H_8$(CHAg)=3.0000E+00
$C_3H_6O$(a)=3.0000E+00
$CH_4$=1.0000E−02
$CH_3OC$(l)=1.0000E+01
$O_2$(g)=2.0900E−01
$N_2$(g)=4.0000E−01.

The graph slightly to the right of 15 mol oxygen shows where small amounts of $CO_2$ and $H_2O$ are detected. The hydrogen level is below the CO level.

Example 12c

Second Blend of Toluene, Acetone and Methanol

Figure 13:
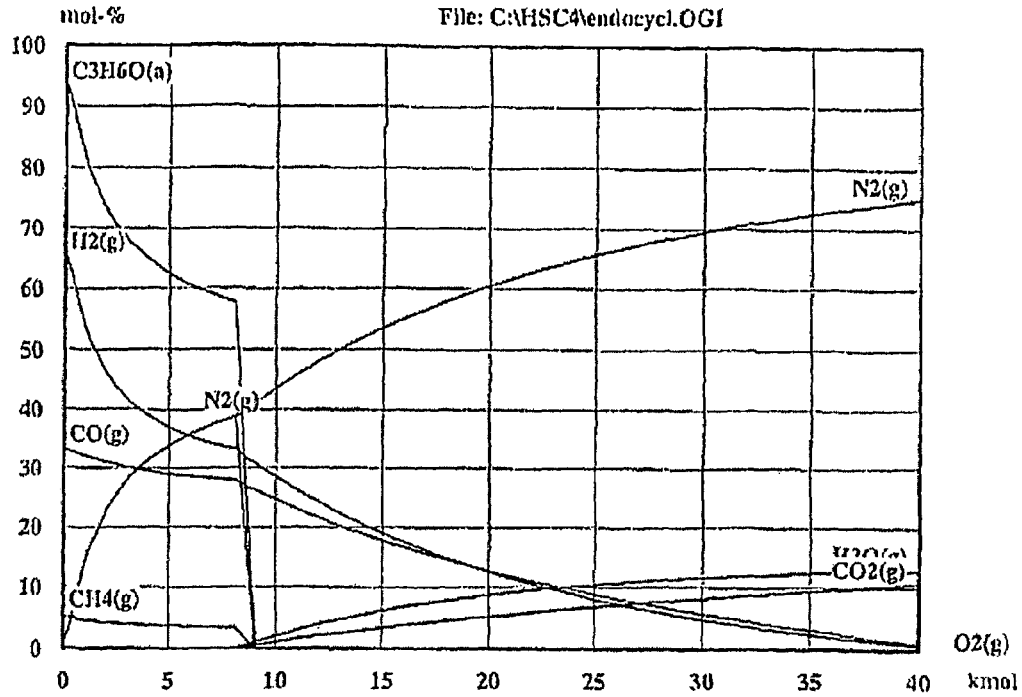
FIG. 13 is a HSC graph showing, in moles (mol % v kmol), for a second blend of acetone, toluene and methanol.
Figure 15:
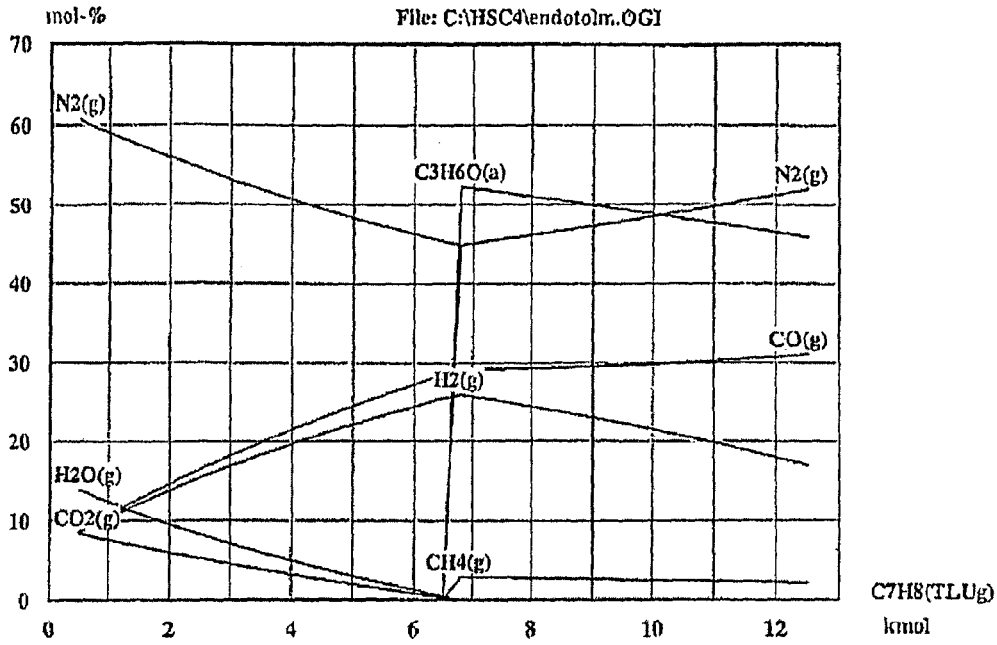
FIG. 15 is a HSC graph showing, in moles (mol % v kmol), for a blend of acetone and methanol.

A second blend was tested using a mixture of toluene, acetone and methanol. The mixture was comprised of about 26% toluene, about 55% acetone, and about 18% methanol, as can be seen by referring to the HSC graph in FIG. 13. The parameters were as HSC graph in FIG. 15. The parameters were as follows for the formation of Gas at 1000° C.: Temperature at 1273.150° K, Pressure at 1.000 bar, Raw materials—kmol, and $C_6H_6$(BZEg)=5.0000E−02
$C_7H_8$(CHAg)=5.0000E−01
$C_3H_6O$(a)=6.0000E+00
$CH_4$=1.0000E−02
$CH_3OC$(l)=1.2000E+01
$O_2$(g)=3.0000E+01
$N_2$(g)=1.2000E+02.

The graph slightly to the right of 6 mol oxygen shows where only small amounts of $CO_2$ and $H_2O$ are detected. The hydrogen level is below the CO level.

Example 12f

Blend of Methanol and Air

The generator was operated directly with methanol and air. Very high levels of CO and hydrogen were obtained. The nitrogen levels were changed by changing the air additions. Since up to about 98% methanol with 2% air can readily be injected, it is possible to get CO levels in the 30 to 32% range and hydrogen levels in the 60 to 64% range.

With air additions, the CO and hydrogen levels can be dropped and nitrogen increased. The $CO_2$ and $H_2O$ levels are typically placed between 0.2% and 1.0%, depending on air additions.

Example 12g

Blend of Acetone, Methanol and Cyclohexane

Direct injection was also applied directly to a Batch Integral Quench furnace. The chemicals used were acetone, methanol, and cyclohexane. Good results were also obtained.

Example 12h

Blend of Cyclohexane, Toluene and Acetone

In addition to operating the endogenerator with the injector, the furnace was operated with an injector and "enriched" the atmosphere with cyclohexane, toluene, and acetone. Good results were also obtained.

Example 12i

Blend of Methanol and Cyclohexane

In blends where the hydrocarbons should not be mixed, the present invention also provides for the direct injection of each gas into the atmospheric furnace. The gases vaporize upon entering the furnace so there is no safety hazard. The Blend of methanol and cyclohexane was directly and separately injected into a Batch Integral Quench furnace. Good results were also obtained.

Example 12j

Blend of Acetone and Air

Also, in another example, an atmosphere was generated without an externally generated carrier using air and acetone. Good results were also obtained.

Example 12k

Blend of Cyclohexane and Air

Also, in another example, an atmosphere was generated without an externally generated carrier using air and cyclohexane. Good results were also obtained.

Example 13

Carbonitriding with the Addition of Ammonia

In another embodiment, the invention also works as described with the addition of ammonia which serves as a source of hydrogen as well as providing monatomic nitrogen. Within the field of carbonitriding using ammonia, typically ammonia is used at temperatures in the range of 900° F. to 1100° F. for the process described as ferritic nitrocarburizing and at higher temperatures in the range of 1525° F. to 1640° F. described as carbonitriding. Both of the aforementioned processes typically use ammonia as the source of nitrogen.

Example 14

Carbonitriding with the Addition of Monatomic Nitrogen

In another embodiment, the invention also works as described with the addition of ring hydrocarbons which contain monatomic nitrogen. These hydrocarbons are classified within the definition of cyclic hydrocarbons and are a source for, not only the carbon for carburizing, but also the monatomic nitrogen for carbonitriding.

In another embodiment, it is possible to supply a cyclic hydrocarbon for supplying both activated carbon and monatomic nitrogen simultaneously from one hydrocarbon compound. There are cyclic compounds available with at least one carbon in the ring replaced by one "N" in monatomic form. This compound at such time as ring rupture, fractures or cracks, releasing carbon for placing carbon in solution with the iron and likewise releases monatomic nitrogen for placing nitrogen in solution with the iron at the same time.

Example 15

Carbonitriding with the Nitrogen Groups

In addition or alternately, there are cyclic hydrocarbons that have NH and $NH_2$ components attached to any of the carbons in the ring. Many of these compounds have more than one NH or $NH_2$ group and may have these groups with or without the methyl or ethyl groups. It is also possible to select from the group that have $NHCH_3$ groups attached. It is therefore possible to supply by choice of compounds different carbon to nitrogen ratios in the case altering gas. For example, cyclic hydrocarbons such as aniline or methylpiperidine or follows for the formation of Gas at 1000° C.: Temperature at 1273.150° K, Pressure at 1.000 bar, Raw materials—kmol, and $C_6H_6$(BZEg)=5.0000E−02
$C_7H_8$(CHAg)=1.4000E+00
$C_3H_6O$(a)=3.0000E+00
$CH_4$=1.0000E−02
$CH_3OC$(l)=1.0000E+01
$O_2$(g)=1.0000E−01
$N_2$(g)=4.0000E−01.

The graph slightly to the left of 10 mol oxygen shows where small amounts of $CO_2$ and $H_2O$ are detected. The hydrogen level is below the CO level after about 18-20 mol oxygen.

Example 12d

Third Blend of Toluene, Acetone and Methanol

Figure 14:
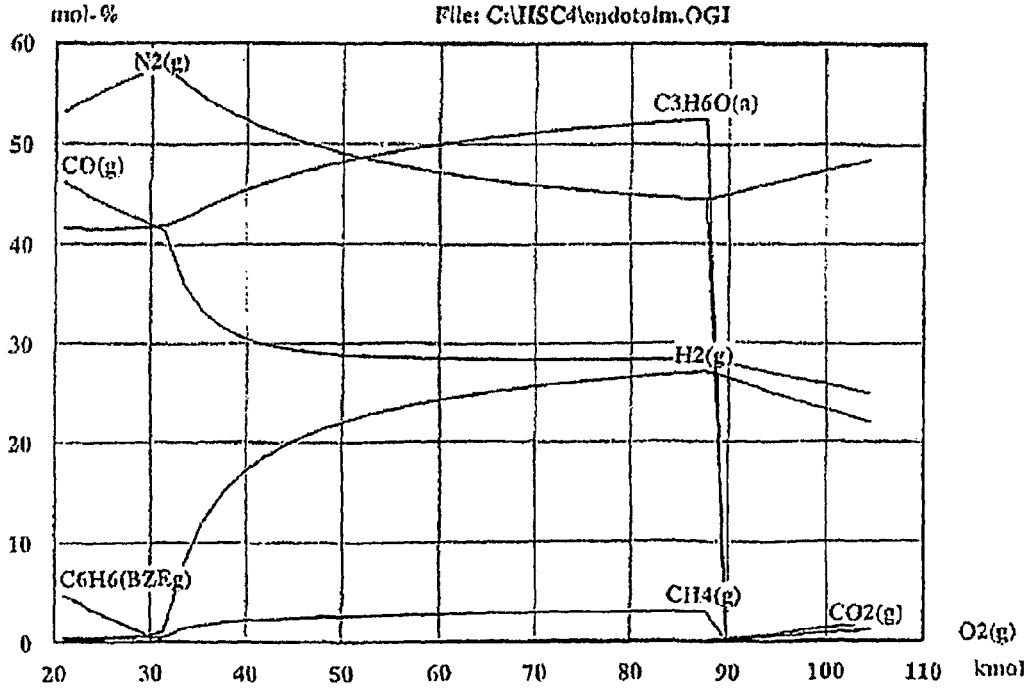
FIG. 14 is a HSC graph showing, in moles (mol % v kmol), for a third blend of acetone, toluene and methanol.

A third blend was tested using a mixture of toluene, acetone and methanol. The mixture was comprised of about 20% toluene, about 60% acetone, and about 20% methanol, as can be seen by referring to the HSC graph in FIG. 14. The parameters were as follows for the formation of Gas at 1000° C.: Temperature at 1273.150° K., Pressure at 1.000 bar, Raw materials—kmol, and $C_6H_6$(BZEg)=5.0000E−01
$C_7H_8$(CHAg)=1.0000E+00
$C_3H_6O$(a)=3.0000E+00
$CH_4$=1.0000E−02
$CH_3OC$(l)=1.0000E+01
$O_2$(g)=1.0000E−01
$N_2$(g)=4.0000E−01.

The graph slightly to the left of 10 mol oxygen shows where small amounts of $CO_2$ and $H_2O$ are detected. The hydrogen level is below the CO level after about 95 mole oxygen.

Example 12e

Blend of Acetone and Methanol

A blend was tested using a mixture of acetone and methanol. The mixture was comprised of about 80% acetone, and about 20% methanol, as can be seen by referring to the piperidine, speridine, caffeine and nicotine are some hydrocarbons that are suitable. In another example, the blend comprises methanol and nitrogen.

There are also saturated hydrocarbons such as cyclohexylamine also called aminocyclohexane or cyclohexanamine which have suitable boiling and freeze points that are available in liquid form and are suitable to operate with liquid injection systems described herein.

It is also recognized that many of these compounds are considered environmentally unfriendly. However, it is believed that upon contact with the iron article, the hydrocarbon will likewise decompose by catalytic reaction (as with the carburizing hydrocarbons of the present invention) on the steel article and leave the furnace as methane or $N_2$.

Should it be determined that some small percentages of such compounds remain, after the burning of exhaust gases by the furnace's pilot burning effluent stack, provisions could be added to either catalytically destruct such materials or oxidize such materials outside the furnace chamber.

H. COMPARATIVE EXAMPLES

Comparative Example A Class "302" Atmosphere

The typical Class "302" endothermic gas atmosphere is 40% nitrogen, 20% CO, and 40% hydrogen, trace levels of $CO_2$ and water vapor. In an atmosphere carburizing or hardening furnace, typically a Class "302" atmosphere is piped to the furnace or an atmosphere is created by flowing nitrogen typically or air in conjunction with a liquid dripped into the furnace such as methanol or acetone. This atmosphere has a carbon potential typically between 0.20% carbon and 0.45% carbon. When other hydrocarbons are used, the mix changes somewhat for the three main gas compounds.

During the carburization process, CO delivers the carbon to the article primarily with free methane second and for higher temperatures. As the carburizing process occurs, hydrogen is an off gas. Typically, the base hydrogen levels of 40% in Class "302" gas increase and dilute the process. Hydrogen levels approaching 50% have been seen when heavy carburization is occurring. Excess hydrogen levels will compete in the process and have the effect of lowering carbon potential. Therefore, having a carrier gas with some hydrogen is good for article brightness and equilibrium against water vapor, however levels in the 40% to 50% range are not necessary and counterproductive to the process.

It is typical for carburizing to raise the carbon potential to 0.80% or higher. To do so, an enrichment gas, typically propane or methane is added to the furnace. During this time, the demand for carbon by a green work piece will consume the enrichment gas. As carbon consumption occurs, $CO_2$ and water vapor levels rise and conversely carbon potential falls.

To lower the $CO_2$ and water vapor levels, the enriching gas is added. There are three primary reactions; $CH_4+CO_2$ become $2\,CO+2H_2$, and likewise $H_2O+CH_4$ becomes CO and $3H_2$. When equilibrium is achieved at a given carbon potential set point, likewise $CO_2$ and $H_2O$ levels will also be stabilized in equilibrium. The third reaction is temperature dependent and $CH_4$ goes to carbon into the work surface and $2H_2$ is generated. There are other reactions that occur with oxygen; further, to drive the reaction forward, hydrogen is generated from all three reactions as a resultant.

Control of enriching gas is done by a motorized valve operator or a time proportioned on/off solenoid valve. Gases again, are typically methane or propane. One of the problems associated with methane specifically is the excess amounts of hydrogen generated dilute the otherwise desired CO. Since methane has two $H_2$'s per molecule of carbon, an abundance of hydrogen is generated and a likewise fall in CO occurs, more so with this hydrocarbon than the other higher orders. CO has been seen to fall to as low as 15%.

Those familiar with the art describe the fall in CO as "CO depletion". The net result carbon potential is difficult to achieve and methane levels are raised due to the fact that insufficient CO is available to react with the methane and raise the carbon potential. The above effect is most prevalent on high surface area loads. The described effect is less severe with propane gas due to the reduced hydrogen to carbon ratio.

In contrast, according to the present invention and the examples below, having higher than the traditional 20% CO levels is beneficial to carburizing and can accelerate the process when the demand for carbon is great at the beginning of the cycle. When CO is about 18% or less, carburizing begins to be impaired.

Comparative Example B

Class "302" Atmosphere with Methanol

The present invention is also different from the use of an atmosphere similar to a Class "302" atmosphere that can be made by directly dripping methanol into a furnace with a nitrogen balance. Typical flow rate would be 160 cfh nitrogen and one gallon per hour methanol. Control of methanol is critical during these operations.

Such atmosphere is designed to yield a 20% equivalent CO level. Should too much methanol be added, CO is higher and can overcarburize an article. Likewise, if methanol flow rate is too low, a article can be undercarburized. The drip system meters methanol through a small needle valve that is difficult to hold on set point and to achieve an accurate amount delivered into the furnace. Also, the inlet "sparger" tube is prone to becoming plugged with carbon and methanol flow rates will drop off or shut off completely.

The invention has been described with reference to preferred and alternative embodiments. Obviously, alterations and modifications will occur to those skilled in the art upon reading and understanding the detailed description of the invention set forth above.

It should be clear to those skilled in the art that the invention will work if other carburizing gases, say in liquid form, can be blended with the hydrocarbons and the blended mixture be metered into the furnace. The added carburizing gases then carburize, and the hydrocarbons disclosed herein carburize as disclosed herein. Of course, the "blend" may contain hydrocarbons as a major component thereof, for example, 50% or more of the blend would be formulated from saturated hydrocarbons. It is intended to include all such alterations and modifications insofar as they come within the scope of the present invention.

While the invention has been described with reference to various and preferred embodiments, it should be understood by those skilled in the art that various changes may be made and equivalents may be substituted for elements thereof without departing from the essential scope of the invention. In addition, many modifications may be made to adapt a particular situation or material to the teachings of the invention without departing from the essential scope thereof. Therefore, it is intended that the invention not be limited to the particular embodiment disclosed herein for carrying out this invention, but that the invention will include all embodiments falling within the scope of the claims.

We claim:

1. An atmospheric furnace for treating one or more metallic articles therein comprising:

an atmospheric furnace chamber having an oxygen-present environment maintained at least at atmospheric pressure configured for at least one of carburizing, hardening and carbonitriding metallic articles; and one or more injectors, each injector having an inlet connected with a source of a liquid hydrocarbon material, and an outlet connected with the atmospheric furnace chamber, the injector adapted to deliver a metered quantity of atomized liquid hydrocarbon material into the atmospheric furnace chamber, and adapted to deliver pulsed atomized liquid hydrocarbon material at a pulse duration of about 800 milliseconds or less.

2. The atmospheric furnace of claim 1, further including more than one supply of liquid hydrocarbon material, wherein each supply is in fluid communication with a supply conduit capable of receiving and combining the separate supplies of liquid hydrocarbon materials and delivering the combined supplies to the atmospheric furnace and/or a catalyst bed.

3. The atmospheric furnace of claim 1, wherein the injectors include at least one primary injector for providing a first quantity of the liquid hydrocarbon material, and at least one trim injector for providing a second quantity of the same or a different liquid hydrocarbon material.

4. The atmospheric furnace of claim 1, wherein the injector is adapted for pulsing discrete quantities of the liquid hydrocarbon material at one or more of: set time intervals; variable time intervals; set pulse widths and/or frequencies; and variable pulse widths and/or frequencies.

5. The atmospheric furnace of claim 1, further including: a hydrogen gas inlet in fluid communication with the atmospheric furnace chamber, the hydrogen gas inlet adapted for receiving a source of hydrogen gas; and a hydrogen metering device adapted for metering the hydrogen through the hydrogen gas inlet into the atmospheric furnace chamber.

6. The atmospheric furnace of claim 1, further including a nitrogen inlet in fluid communication with the atmospheric furnace chamber for adding a source of monatomic nitrogen into the atmospheric furnace chamber.

7. A generator for an atmospheric furnace for treating one or more articles comprising:

at least one catalyst bed connected to an atmospheric furnace, the atmospheric furnace having an oxygen-present environment maintained at least at atmospheric pressure configured for at least one of carburizing, hardening and carbonitriding metallic articles; and one or more injectors, each injector having an inlet connected with a source of a liquid hydrocarbon material, and an outlet connected with the catalyst bed, the injector adapted to deliver a metered quantity of atomized liquid hydrocarbon material into the catalyst bed.

8. A generator of claim 7, further including a heating device adapted to one or more of: externally heating an expansion chamber; providing heat from a catalyst heating system, or providing heat from a product gas cooler.

9. A generator of claim 7, further including more than one supply of liquid hydrocarbon material, wherein each supply is in fluid communication with a supply conduit capable of receiving and combining the separate supplies of liquid hydrocarbon materials and delivering the combined supplies to the atmospheric furnace and/or the catalyst bed.

10. A generator of claim 7, wherein the injectors include at least one primary injector for providing a first quantity of the liquid hydrocarbon material, and at least one trim injector for providing a second quantity of the same or a different liquid hydrocarbon material.

11. A generator of claim 7, wherein the injector has a pulsing mechanism configured for pulsing discrete quantities of the liquid hydrocarbon material at one or more of: set time intervals; variable time intervals; set pulse widths and/or frequencies; and variable pulse widths and/or frequencies.

12. An enrichment system for an atmospheric furnace for treating one or more metallic articles comprising:

one or more injectors, each injector having an inlet connected with a source of a liquid hydrocarbon material, and an outlet connected to an atmospheric furnace, the atmospheric furnace being configured for at least one of carburizing, hardening and carbonitriding metallic articles, the atmospheric furnace chamber having an oxygen-present environment maintained at least at atmospheric pressure;

the injector adapted to deliver a metered quantity of atomized liquid hydrocarbon material into the atmospheric furnace, and adapted to deliver pulsed atomized liquid hydrocarbon material at a pulse duration of about 800 milliseconds or less.

13. An enrichment system of claim 12, further including a nitrogen inlet connected to the atmospheric furnace chamber for adding a source of nitrogen introduced into the atmospheric furnace.

14. An enrichment system of claim 12, further including more than one supply of liquid hydrocarbon material, wherein each supply is in fluid communication with a supply conduit capable of receiving and combining the separate supplies of liquid hydrocarbon materials and delivering the combined supplies to the atmospheric furnace and/or a catalyst bed.

15. An enrichment system of claim 12, wherein the injectors include at least one primary injector for providing a first quantity of the liquid hydrocarbon material, and at least one trim injector for providing a second quantity of the same or a different liquid hydrocarbon material.

16. An enrichment system of claim 12, wherein the injector has a pulsing mechanism configured for pulsing discrete quantities of the liquid hydrocarbon material at one or more of: set time intervals; variable time intervals; set pulse widths and/or frequencies; and variable pulse widths and/or frequencies.

17. A carrier system for an atmospheric furnace for treating one or more metallic articles comprising:

one or more injectors, each injector having an inlet connected with a source of a liquid hydrocarbon material, and an outlet connected to an atmospheric furnace, the atmospheric furnace having an oxygen-present environment maintained at least at atmospheric pressure configured for at least one of carburizing, hardening and carbonitriding metallic articles;

the injector being adapted to deliver a metered quantity of atomized liquid hydrocarbon material into the atmospheric furnace, and adapted to deliver pulsed atomized liquid hydrocarbon material at a pulse duration of about 800 milliseconds or less.

18. A carrier system of claim 17, further including more than one supply of liquid hydrocarbon material, wherein each supply is in fluid communication with a supply conduit capable of receiving and combining the separate supplies of liquid hydrocarbon materials and delivering the combined supplies to the atmospheric furnace and/or a catalyst bed.

19. A carrier system of claim 17, wherein the injectors include at least one primary injector for providing a first quantity of the liquid hydrocarbon material, and at least one trim injector for providing a second quantity of the same or a different liquid hydrocarbon material.

20. A carrier system of claim 17, wherein the injector has a pulsing mechanism configured for pulsing discrete quantities of the liquid hydrocarbon material at one or more of: set time intervals; variable time intervals; set pulse widths and/or frequencies; and variable pulse widths and/or frequencies.

21. A method for treating one or more metallic articles in an atmospheric furnace, the atmospheric furnace having an oxygen-present environment maintained at least at atmospheric pressure, and being configured for at least one of carburizing, hardening, nitriding (including carbonitriding and ferriticnitriding), bluing, blackening, controlled oxidizing and/or controlled reduction, the method comprising:

heating the article to a carburizing, hardening, nitriding (including carbonitriding and ferriticnitriding), bluing, blackening, controlled oxidizing and/or controlled reduction temperature in the atmospheric furnace, metering one or more liquid hydrocarbon materials into the atmospheric furnace by injector pulsing the liquid hydrocarbon material until a set carbon potential is achieved, the injector delivering pulsed atomized liquid hydrocarbon material at a pulse duration of about 800 milliseconds or less, whereby the liquid hydrocarbon material either disassociates to produce an elemental material that is absorbed into an outer surface of the article, or creates a desired environment around the article; and measuring carbon dioxide, dew point, or oxygen levels in the atmospheric furnace.

22. The method of claim 21, including injecting the liquid hydrocarbon material into the atmospheric furnace whereby the liquid hydrocarbon material is vaporized into a gas or into an atomized liquid from the heat of the atmospheric furnace.

23. The method of claim 22, further including—providing one or more injectors connected to the atmospheric furnace, and injection pulsing the liquid hydrocarbon material, into the atmospheric furnace by the injector.

24. The method of claim 23, wherein the injection pulsing is fixed or variably set for at least one of: pulse time, pulse width and/or pulse frequencies.

25. The method of claim 21, wherein the liquid hydrocarbon material comprises one or more hydrocarbon enrichment materials to raise or lower carbon potential.

26. The method of claim 21, wherein the liquid hydrocarbon material comprises at least one hydrocarbon material selected from at least one, or a blend, of: toluene, acetone, methanol; cyclohexane, and acetone.

27. The method of claim 21, wherein the liquid hydrocarbon material comprises at least one, or a blend, of: an unsaturated hydrocarbon having greater than 4 carbons; a cyclic hydrocarbon comprising at least one 5 or 6 sided carbon ring; saturated hydrocarbons; and blends thereof; an alcohol including methanol, ethanol, butanol, and blends thereof; a ketone including acetone, methyl ketone, ethyl ketone, and blends thereof; a liquefied propane, butane, pentane, hexane, heptane, octane and blends thereof, an unsaturated chain hydrocarbon including ethylene, propylene, butene, pentene, hexene, heptene, octene and blends thereof; a saturated cyclic hydrocarbon including cyclopropane including methylcyclopropane; cyclobutane; cyclopentane, including methylcyclopentane and ethylcyclopentane; cyclohexane including methylcyclohexane, ethylcyclohexane, dimethyl cyclohexane, trimethyl cyclohexane; cyclopentane, and blends thereof; an unsaturated cyclic hydrocarbon including benzene, toluene, xylene and blends thereof; and, diesel, jet fuel, kerosene, gasoline, and blends thereof.

28. The method of claim 21, wherein one or more of ammonia or other source of nitrogen are metered into the atmospheric furnace.

29. The method of claim 21, further including adding a source of monatomic nitrogen into the atmospheric furnace.

30. The atmospheric furnace of claim 1, further including an inlet connected to a supply of liquid hydrocarbon material, wherein the supply of the liquid hydrocarbon material comprises multiple, miscible liquid hydrocarbon materials as a single supply.

31. The atmospheric furnace of claim 1, further including an inlet connected to a supply of liquid hydrocarbon material, wherein the supply of the liquid hydrocarbon material comprises multiple, nonmiscible liquid hydrocarbon materials, wherein each nonmiscible liquid hydrocarbon material is stored as a separate supply.

* * * * *